US005469648A

United States Patent [19]

Jones et al.

[11] Patent Number: 5,469,648

[45] Date of Patent: Nov. 28, 1995

[54] EXCAVATING TOOTH

[75] Inventors: Larren F. Jones, Aloha; Robert K. Emrich, Tigard; Ian R. Bingham, Beaverton, all of Oreg.

[73] Assignee: Esco Corporation, Portland, Oreg.

[21] Appl. No.: 291,711

[22] Filed: Aug. 16, 1994

Related U.S. Application Data

[63] Continuation-in-part of Ser. No. 12,467, Feb. 2, 1993, abandoned.

[51] Int. Cl.[6] ..... E02F 9/28

[52] U.S. Cl. ..... 37/457; 37/455

[58] Field of Search ..... 37/457, 458, 456, 37/455, 452, 446

[56] References Cited

U.S. PATENT DOCUMENTS

| | | | |
|---|---|---|---|
| 2,312,802 | 3/1943 | Crawford . | |
| 2,368,611 | 1/1945 | Clavnoce | 37/457 |
| 2,568,075 | 9/1951 | Launder . | |
| 2,669,153 | 2/1954 | Launder . | |
| 2,702,490 | 2/1955 | Launder . | |
| 3,511,126 | 5/1970 | Watts . | |
| 3,526,435 | 9/1970 | Knekeler | 37/457 |
| 3,733,722 | 5/1973 | Launder . | |
| 3,748,762 | 7/1973 | Tarrant . | |
| 3,774,324 | 11/1973 | Lafond . | |
| 3,879,867 | 4/1975 | Ericson et al. . | |
| 3,894,349 | 7/1975 | Moreau . | |
| 4,087,928 | 5/1978 | Mickus . | |
| 4,129,934 | 12/1978 | Gettman . | |
| 4,155,665 | 5/1979 | Kaarlela . | |
| 4,192,089 | 3/1980 | Schwappach . | |
| 4,213,257 | 7/1980 | Johansson et al. . | |
| 4,231,173 | 11/1980 | Davis . | |
| 4,271,615 | 6/1981 | Jones . | |
| 4,355,532 | 6/1982 | Hahn et al. . | |
| 4,446,638 | 5/1984 | Novotny et al. . | |
| 4,481,728 | 11/1984 | Mulder et al. . | |
| 4,516,340 | 5/1985 | Launder . | |
| 4,579,494 | 4/1986 | Bierwith . | |
| 4,596,318 | 6/1986 | Bidol . | |
| 4,823,487 | 4/1989 | Robinson . | |
| 4,835,888 | 6/1989 | Hemphill . | |
| 4,881,331 | 11/1989 | Paizes . | |
| 4,911,505 | 3/1989 | Emrich | 37/457 |
| 4,965,945 | 10/1990 | Emrich . | |
| 5,068,986 | 12/1991 | Jones . | |
| 5,074,062 | 12/1991 | Hahn et al. . | |
| 5,134,793 | 8/1992 | Bierwith . | |
| 5,152,088 | 10/1992 | Hahn . | |
| 5,361,520 | 11/1994 | Robinson . | |

FOREIGN PATENT DOCUMENTS

| | | | |
|---|---|---|---|
| 2930804 | 2/1981 | Germany | 37/457 |

*Primary Examiner*—Dennis L. Taylor
*Assistant Examiner*—Spencer K. Warnick
*Attorney, Agent, or Firm*—Banner & Allegretti, Ltd.

[57] ABSTRACT

An excavating tooth for use on a wide variety of excavating equipment is comprised of a point, an adapter and a sandwich lock pin. The pin includes a rigid casing and a plurality of independently depressible protrusions. One of the protrusions resiliently engages a face defined on the nose of the adapter to tighten the connection of the point on the nose. One other of the protrusions extends into an opening defined by the point to secure the lock pin to the point. With respect to an external locking tooth, the opening defined in the point includes a pair of bosses which define a reduced portion of the opening. The reduced portion matingly receives and holds the ends of the rigid casing of the pin. The independent locking of the pin and the mating receipt of the casing in the point opening reduces the likelihood of pin loss due to overloading of the elastomeric material, wearing of the components or jacking forces.

40 Claims, 11 Drawing Sheets

10
12
14
16
18
20
22
28a
28b
34
35
38
42
46a
46b
48a
48b
50
50a
50b
54
56
57
58
59
64
65
67
72
82
83a
84
117
125
142
155a
155b
159

EXCAVATING TOOTH

This application is a continuation-in-part of U.S. patent application Ser. No. 08/012,467, filed Feb. 2, 1993, now abandoned.

FIELD OF THE INVENTION

The present invention pertains to an excavating tooth adapted for use on excavating equipment of all kinds—such as, front end loaders, backhoes, draglines, rippers, etc.

BACKGROUND AND SUMMARY OF THE INVENTION

In mining and construction, most excavating equipment ordinarily include a series of spaced apart teeth mounted across a bucket lip. The teeth project forwardly to engage and break up the material to be gathered in the bucket. As can be appreciated, the teeth are subjected to highly abrasive conditions and thus experience considerable wearing.

In order to minimize the loss of material due to replacement of parts, the teeth are manufactured as two parts—an adapter and a point. The adapter is attached (e.g., by welding) to the bucket's lip and includes a forwardly projecting nose. The point defines a rearwardly opening socket into which the adapter nose is received and includes a front digging edge. The point substantially envelops the adapter nose and thereby tends to protect the nose from wear. As a result, however, the point is subjected to abrasive conditions and must be frequently replaced. In general, five to thirty points may be successively mounted onto a single adapter, depending upon the severity of the application. Due to the large loads and impacts applied to the teeth, it is essential that the points be securely locked to the adapters. Yet, since the points are changed in the field, the locks must be easily set and released. While many styles of locks have been developed, they commonly include the use of a lock pin.

According to one common arrangement, the point and adapter nose are each provided with a central locking aperture. When the parts are assembled, the apertures are aligned to enable receipt of a lock pin. In some cases, a rigid pin is used in combination with a resilient keeper member. The keeper member is employed to hold the pin in the apertures and to tighten the engagement of the point over the adapter nose. An example of this type of tooth is disclosed in U.S. Pat. No. 2,312,802 to Crawford. In an alternative arrangement, a sandwich pin may be used without a separate keeper member. In general, a sandwich pin is comprised of a rigid portion to provide adequate strength to hold the point to the adapter and a resilient portion to secure the pin in place and tighten the connection of the parts. An example of this construction is set forth in U.S. Pat. No. 4,823,487 to Robinson.

Teeth with these constructions, however, experience a number of shortcomings. The formation of central apertures in both the point and adapter nose weakens the overall strength of the tooth. In addition, under heavy longitudinal loading of the point, the keeper or elastomeric portion of the lock is forced to accept loads beyond its capacity. This phenomenon is exacerbated in situations involving a partially worn adapter nose. Frequent or cyclic overloading of the resilient component can result in premature failure of the member. Failure of the keeper or elastomer can lead to loss of the pin and hence the point. If a point is lost, the adapter will be quickly ruined as the nose is not made to resist highly abrasive conditions.

In use, points are often subjected to jacking or fluttering forces. More specifically, as the point is forced through the ground it is constantly exposed to endless variations in resistance caused by rocks, roots, concrete and other discontinuities in the ground. These variations are magnified in front end loaders which are driven forward along the ground and thus experience additional vertical and transverse movements of the bucket during loading. In any event, these variations in resistance tend to apply forces having significant vertical components to the points. Moreover, the loads generally reverse directions at a rapid rate on the point such that upward and downward forces act repeatedly on the points. In large operations loads upwards of 200,000 pounds would not be unexpected.

As can be appreciated, a vertical load on the front edge of the point tends to apply a large moment force to the point, which if not resisted, would rotate the point off the adapter nose. These moment forces also apply large stresses on the bearing faces of the nose and cause deformation and wear to the nose. Moreover, as can be seen in FIG. 2 of the '487 patent, the rear wall of the aperture in the point engages the rear of the lock pin. As the point is forced to rotate under the moment force, a corresponding force (i.e., one with a vertical component) is applied to the pin. With constant reversing of the loads in jacking forces, the pin can be worked free and ejected from the aperture even without failure of the elastomer or over-wearing of the components. Although the unique construction of the adapter nose and the socket of the point in U.S. Pat. No. 4,231,173 to Davis has to some degree alleviated the problem, it does not provide a perfect solution for all applications.

Ejection of the pin can be partially alleviated if the lock pin is inserted through a set of aligned apertures oriented in a horizontal direction (i.e., parallel with the lip of the bucket). A tooth with this construction is referred to as a side locking tooth. An example of such a construction is shown in U.S. Pat. No. 2,669,153 to Launder. With this construction, rotational movements of the point in a vertical plane do not apply forces along the pin's axis to eject the pin. Nevertheless, significant transverse jacking forces can be applied to the point and thus transmitted to the pin along its axis. Moreover, because of the typical close spacing of the teeth on a bucket, very little access space is provided to insert and remove the pins. In the field, the pins are usually manually inserted and removed by an individual using a pointed tool and a sledge hammer. Accordingly, difficulties in replacing the points are frequently encountered. Due to these shortcomings, teeth with this construction have become known as "Knuckle Busters."

In all of these lock assemblies, the point is movable farther up on the adapter nose as the nose becomes worn. As a result, the elastomeric element must expand a corresponding amount to maintain a tight fit and prevent loss of the pin. Once the maximum expansion of the member is reached, the pin may be lost or ejected. Therefore, in order to maximize the life of the components the apertures defined through the point and adapter nose, irrespective of whether they are vertical or horizontal apertures, are typically constructed so that the pin is initially inserted into a very tight arrangement. A tight fit leads to difficulty in inserting and removing the pin. Difficulty in replacing the points causes increased downtime and a greater likelihood that workers may avoid timely replacement of the points.

To overcome many of the disadvantages associated with central and side locking teeth, excavating teeth with external locking constructions have been developed. An example of a popular external locking tooth is shown in U.S. Pat. No.

4,965,945 to Emrich. As can be seen in FIG. 3 of the '945 patent, the point is provided with a pair of vertically spaced lugs which are placed to each side of a central ledge or shoulder formed on the side of the adapter nose. A rigid lock pin is inserted vertically between the lugs of the point and the ledge of the adapter nose to couple the components together. The pin preferably has an arcuate configuration which is slightly flexed (i.e., straightened) when inserted to tighten the overall assembly of the tooth. A transverse resilient plug is provided to lock the pin in place. The plug is comprised of a helical spring encased in a resilient foam material.

This external locking construction avoids the formation of enlarged apertures in the components and thereby provides a stronger tooth. Further, the transverse orientation of the resilient plug shields it from the major forces applied to the point. Overloading of the plug is thus avoided. However, this lock pin and plug combination does not attain the advantages of a one-piece lock.

An alternate external locking construction using a sandwich lock pin, as shown in U.S. Pat. No. 5,152,088 to Hahn, has also been used. In this construction, the adapter nose has a vertical channel defined along one of its sides to receive the pin. The point includes a rearwardly extending tongue in opposed relation to the channel and an inwardly directed lug. The lock pin is comprised of rigid front and rear faces which resist the major loads applied to the point, and an elastomer provided with a pair of transverse locking detents adapted for receipt in recesses defined in the adapter nose and the tongue. While this construction performs well in smaller sized teeth, it does not provide an adequate solution for all circumstances.

The present invention pertains to a tooth, comprised of a point, an adapter and a sandwich pin, which has a construction unknown in the prior art. The tooth of the present invention is much less susceptible to pin loss due to overloading of a pin elastomer, the effects of jacking forces or wear to the adapter nose. Moreover, the points can be readily replaced in the field.

According to one aspect of the invention, an excavating tooth is comprised of an adapter, a point, and a sandwich pin. The adapter includes a forwardly projecting nose and an opening associated with the nose. The point includes a front digging edge, a socket which is matingly received over the adapter nose, and a first opening which aligns with the adapter opening for receipt of the sandwich pin. The point further includes a second opening proximate to the first opening. The pin is comprised of a rigid casing and a plurality of independently depressible protrusions. One of the protrusions resiliently engages a portion of the adapter nose to tighten the attachment of the point onto the nose. At least one other protrusion extends into the second opening of the point to securely lock the pin to the point. The independent operation of the protrusions functions to alleviate pin loss due to overloading of the elastomeric material, the effects of jacking forces or wear to the adapter nose.

According to another aspect of the invention, the sandwich pin includes a rigid casing member and a plurality of elastomeric members. One of the elastomeric members forms a first protrusion which engages and presses against a portion of the adapter nose to effect tightening of the point onto the nose. At least one other elastomeric member forms a second protrusion which functions to lock the pin to the point. The locking elastomer is separate and apart from the tightening elastomer and is shielded from the major forces applied to the point by the rigid casing. Since the locking elastomer is isolated from the loading forces it cannot be overloaded. As a result, pin loss due to failure of an elastomeric member is virtually eliminated. The use of a separate locking elastomer further reduces the likelihood of pin ejection under jacking forces.

In another aspect of the invention, the rigid casing of the pin is matingly received and held in at least a portion of the pin opening defined by the point. In this way, the point independently holds the pin, regardless of the longitudinal position of the point on the adapter nose. This independent holding of the pin causes the pin to move with the point as it is repeatedly jerked under jacking forces. This integral movement of the pin with the point virtually eliminates the thrust forces formerly applied by the point in ejecting the pin from the opening. Hence, the pin is substantially prevented from being lost due to jacking forces or wear to the adapter nose. The holding of the pin by the point also permits the assembly of a "looser" tooth construction. In other words, since the pin is held by the point, the pin does not need to be inserted into a tight tooth assembly. As a result, the pin opening in the present invention can be formed with a minimum clearance to permit easy driving of the pin in the field.

In the tooth illustrated in FIGS. 5–8 of the '487 patent, the lock pin is received into a slot defined in the point. As seen in FIG. 8 thereof, the slot includes shoulders which are shown to matingly receive the pin. However, a closer inspection reveals that the construction is wholly unworkable. More specifically, when the pin is inserted, it is driven vertically downward into the aligned openings. As seen in FIG. 5 thereof, the pin has a central segment rearward of the shoulders which is broader than its end portions. The mating receipt of the pin's end portions in the point openings (as seen in FIG. 8) would preclude the passage of the broader central segment through the same opening. As a result, this patent fails to provide a useful teaching in this regard.

According to another aspect of the invention, a point of an external locking tooth includes a pair of vertically spaced apart lugs disposed rearwardly of the point's body. The lugs are attached to the body by an ear which forms an extension of one of the point's sidewalls. The ear attaches to a sidewall of the point with broad arcuate transition segments at the top and bottom ends of the ear. This broad arcuate configuration is important in maintaining stress levels at this juncture point within a range of acceptable levels. In addition, the body, the ear and the lugs collectively define an opening in which the lock pin is received. A boss is provided opposite each lug to facilitate mating receipt of the pin in the point opening. However, the provision of such a boss requires the formation of a sharper corner between the ear and the body than is desired adjacent the top and bottom ends of the ear. The use of the sharper curvature needed for the boss at the top and bottom ends of the ear would cause greater than desired amounts of stress in the point under heavy loading. The bosses holding the pin in the opening are therefore offset from the top and bottom ends of the ear so that the point is provided with the broad arcuate transition structures as well as the desired bosses.

In another aspect of the invention, a sandwich pin includes an arm which projects rearward to extend between the lugs and the adapter nose when the pin is assembled in an external locking tooth. The arm stabilizes the orientation of the pin to prevent unwanted turning of the pin in the pin opening. The arm also prevents an erroneous insertion of the pin during assembly of the tooth.

In another aspect of the invention, the point defines an opening adapted to receive a lock pin therein. The point further includes a plurality of recesses along the opening to receive locking detents of the inserted pin. This multiple, independent locking construction between the pin and the point creates a positive locking assembly which alleviates unintended release or loss of the pin from the pin opening.

According to another aspect of the invention, the lock pin has a single elastomeric member which uniquely cooperates with a rigid casing to define a pair of independently depressible protrusions. The elastomeric member includes a front protrusion which engages a face of the adapter nose and a rear protrusion which is inserted into a gap defined between a pair of walls or lugs of the point. The front protrusion tightens the connection of the point onto the adapter nose and the rear protrusion locks the pin to the point. The independently depressible nature of the rear protrusion provides a secure locking function to alleviate unintended release of the pin, isolates the rear protrusion from the front protrusion to lessen the affects on the pin of heavy loading, and enhances the mating receipts of the pin's rigid casing in the pin opening of the point to securely lock the pin to the point even when assembled on a worn and loose fitting adapter nose.

DETAILED DESCRIPTION OF THE PREFERRED EMBODIMENT

Figure 16:
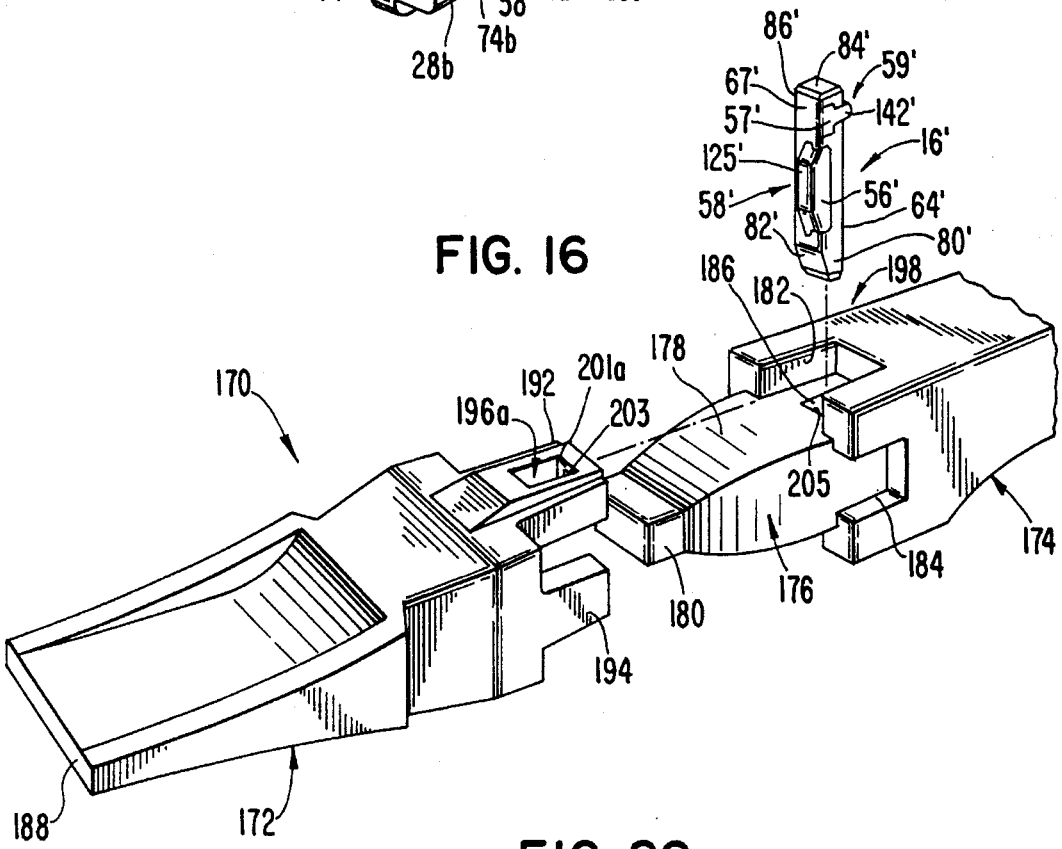
FIG. 16 is an exploded, partial perspective view of a center locking tooth in accordance with a second embodiment of the present invention.
Figure 20:
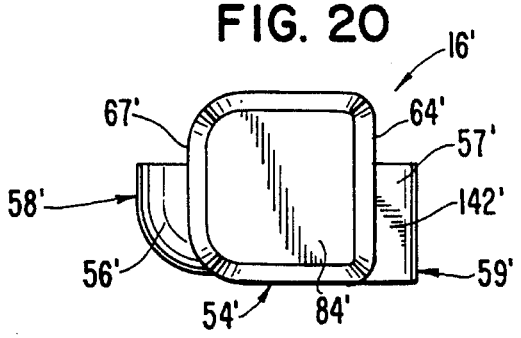
FIG. 20 is a top plan view of the lock pin of the second embodiment.

The present invention pertains to an excavating tooth comprised of a point, an adapter and a sandwich type lock pin. The tooth is adapted to connect to excavating equipment of all kinds for use in a wide variety of operations. As can be appreciated, operation of the equipment will cause the present teeth to assume many different orientations. Nevertheless, for purposes of explanation, the elements of the teeth are at times described in regard to relative directions such as up and down. These directions should be understood with respect to the orientation of the teeth as shown in FIGS. 1 and 16, unless stated otherwise.

In a preferred embodiment of the present invention (FIGS. 1–15), a tooth 10 includes a point 12, an adapter 14 and a sandwich pin 16. Tooth 10 preferably has an external locking construction similar to that set forth in U.S. Pat. No. 4,965,945 to Emrich, which is incorporated herein by reference. Nevertheless, variations on the construction may also be used.

Figure 1:
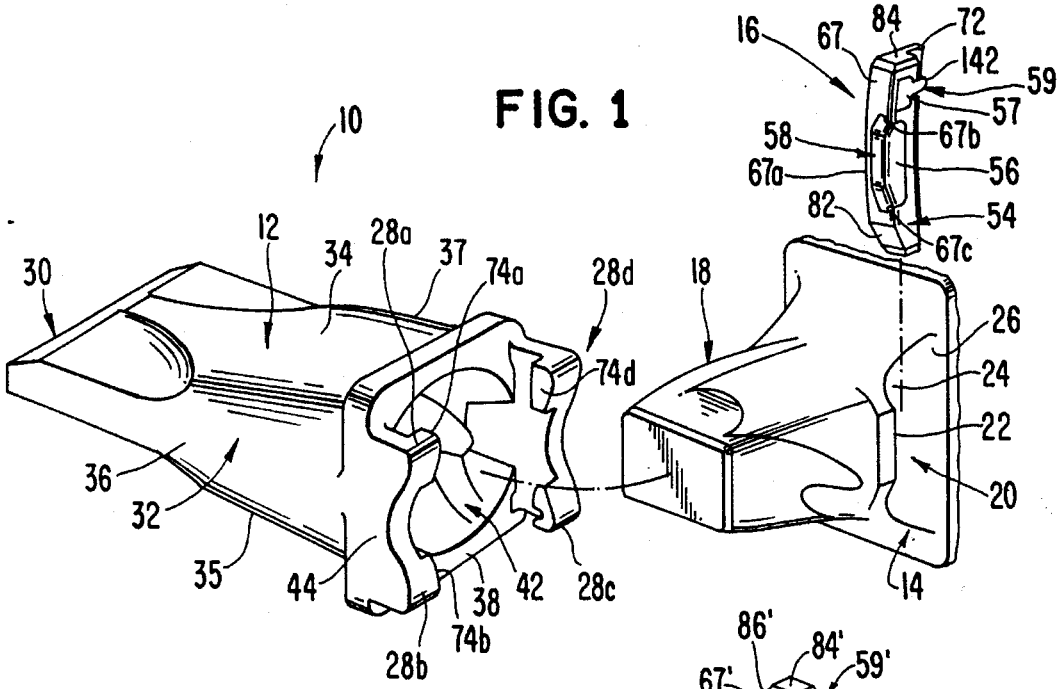
FIG. 1 is an exploded, partial perspective view of an external locking tooth in accordance with one embodiment of the present invention.
Figure 4:
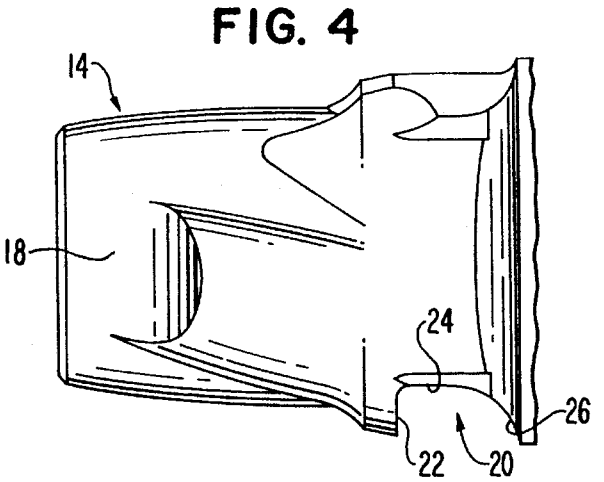
FIG. 4 is a top plan view of the adapter nose of the tooth.
Figure 5:
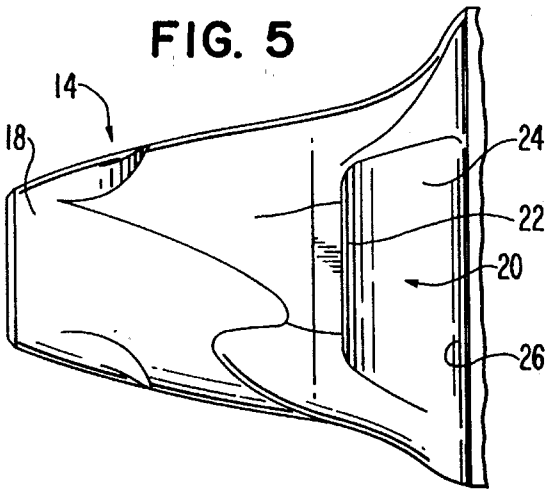
FIG. 5 is a side elevational view of the adapter nose.
Figure 12:
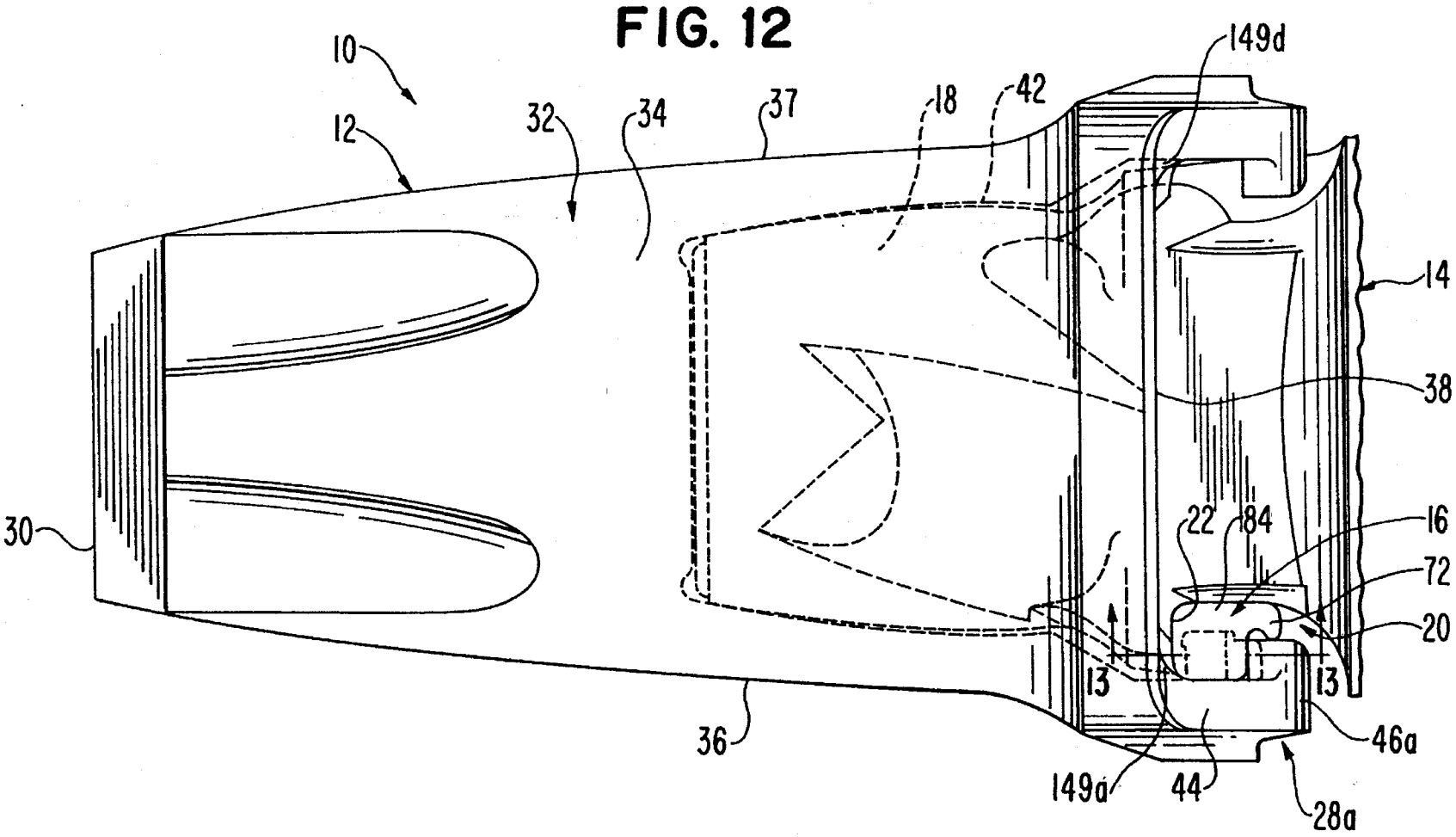
FIG. 12 is a partial, top plan view of the assembled tooth.

Adapter 14 includes a shank (not shown) adapted to be secured to the front lip of a bucket (not shown), and a nose 18 projecting forwardly from the lip (FIGS. 1 and 4–5). Nose 18 is preferably formed with a helical construction similar to that originally set forth in U.S. Pat. No. 4,335,532 to Hahn et al., which is also incorporated herein by reference. The helical construction, however, is not essential to the present invention. A vertically oriented keyway 20 is formed along one side of adapter nose 18. Keyway 20 is defined by a rearwardly facing ledge or shoulder 22, a side wall 24 and a rear wall 26. Side and rear walls 24, 26 preferably merge together in an arcuate transition segment. The keyway is designed and sized to receive lock pin 16 and lugs 28*a*, 28*b* of point 12 (FIGS. 1 and 12).

Figure 2:
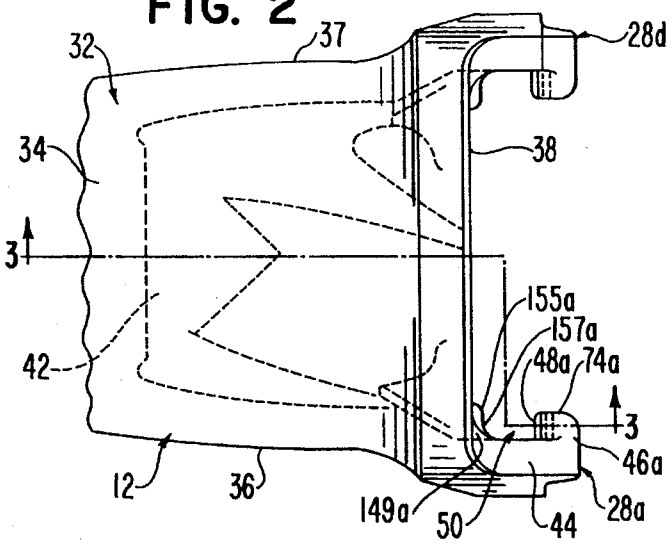
FIG. 2 is a partial top plan view of the point of the tooth.
Figure 3:
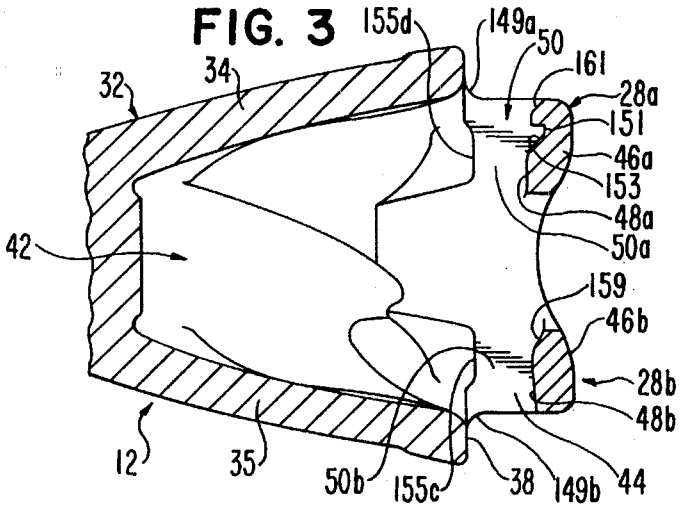
FIG. 3 is a cross sectional view taken along line 3—3 in FIG. 2.

Point 12 has a generally wedge-shaped tapering construction which includes a front digging edge 30 and a body 32 including a socket 42 for receiving adapter nose 18 (FIGS. 1–3). Body 32 is defined by a top wall 34, a bottom wall 35, a pair of side walls 36, 37, and a rear wall 38. Socket 42 opens rearwardly in rear wall 38 to matingly receive therein adapter nose 18 and mount point 12 onto adapter 14. A pair of vertically spaced lugs 28*a*, 28*b* are disposed rearwardly of rear wall 38 to interact with lock pin 16 and keyway 20 to lock the tooth assembly together. Lugs 28*a*, 28*b* are attached to body 32 by an ear 44 which forms an extension of side wall 36. A second pair of lugs 28*c*, 28*d* of the same construction may be provided on the other side of the point to enable the point to be flipped over and thereby extend its useful life. Lugs 28*a*, 28*b* are oriented inwardly at approximately right angles to ear 44.

In use, point 12 is received over adapter nose 18 such that the nose is matingly received in socket 42 (FIGS. 1 and 12–15). Lugs 28*a*, 28*b* are received in the upper and lower portions of keyway 20. Ledge 22 extends substantially vertically between lugs 28*a*, 28*b*. Lugs 28*a*, 28*b*, ear 44, rear wall 38 and keyway 20 cooperatively define a pin opening 50 for receiving lock pin 16 therethrough. As a result, lock pin 16 is driven vertically into and out of pin opening 50 to lock and release point 12 to and from adapter nose 18.

Lock pin 16 is comprised of a rigid casing 54 and a pair of elastomeric members 56, 57 (FIGS. 6–11). Elastomers 56, 57 are received and held within pockets 60, 61 defined in the medial and upper portions, respectively, of casing 54. Elastomer 56 cooperates with a rigid plate 125 to form a first protrusion 58 which resiliently engages ledge 22 of adapter nose 18 to tighten the connection of point 12 on the nose. Elastomer 57 cooperates with a rigid detent 142 to form a second protrusion 59 which is received into a recess 151 (FIG. 15) defined in the point to lock the pin to the point. Elastomer 57 is separate and apart from tightening elastomer 56 and is thus independently depressible and isolated from the loading and wear of elastomer 56.

Casing 54 (FIGS. 6–11) is an elongated rigid member preferably composed of a metallic material. Casing 54 preferably has a slightly arcuate configuration, although a straight pin could also be used. The use of an arcuate pin permits current points to be easily modified to accept the use of lock pin 16. Rear walls 64, 65 of casing 54 are concave in shape while front wall 67 is convex. The concave curvature of rear wall 64 is shaped to conform to the arcuate inner faces 48*a*, 48*b* of lugs 28*a*, 28*b*.

In general, casing 54 has a body segment 70 and a rearwardly extending arm 72. Arm 72 extends along the length of pin 16 and preferably has a generally hook-like configuration; although other shapes could be used. Arm 72 is adapted to extend between the distal ends 74*a*, 74*b* of lugs 28*a*, 28*b* and side wall 24 of keyway 20. Arm 72 includes an end face 76 which abuts ends 74*a*, 74*b* and an inner surface 77 which abuts against side wall 24. Arm 72 functions to stabilize the orientation of pin 16 and prevent unwanted turning of the pin. Arm 72 further prevents the erroneous insertion of pin 16 in keyway 20 during assembly.

Figures 6, 7, 8, 9, 10, 11:
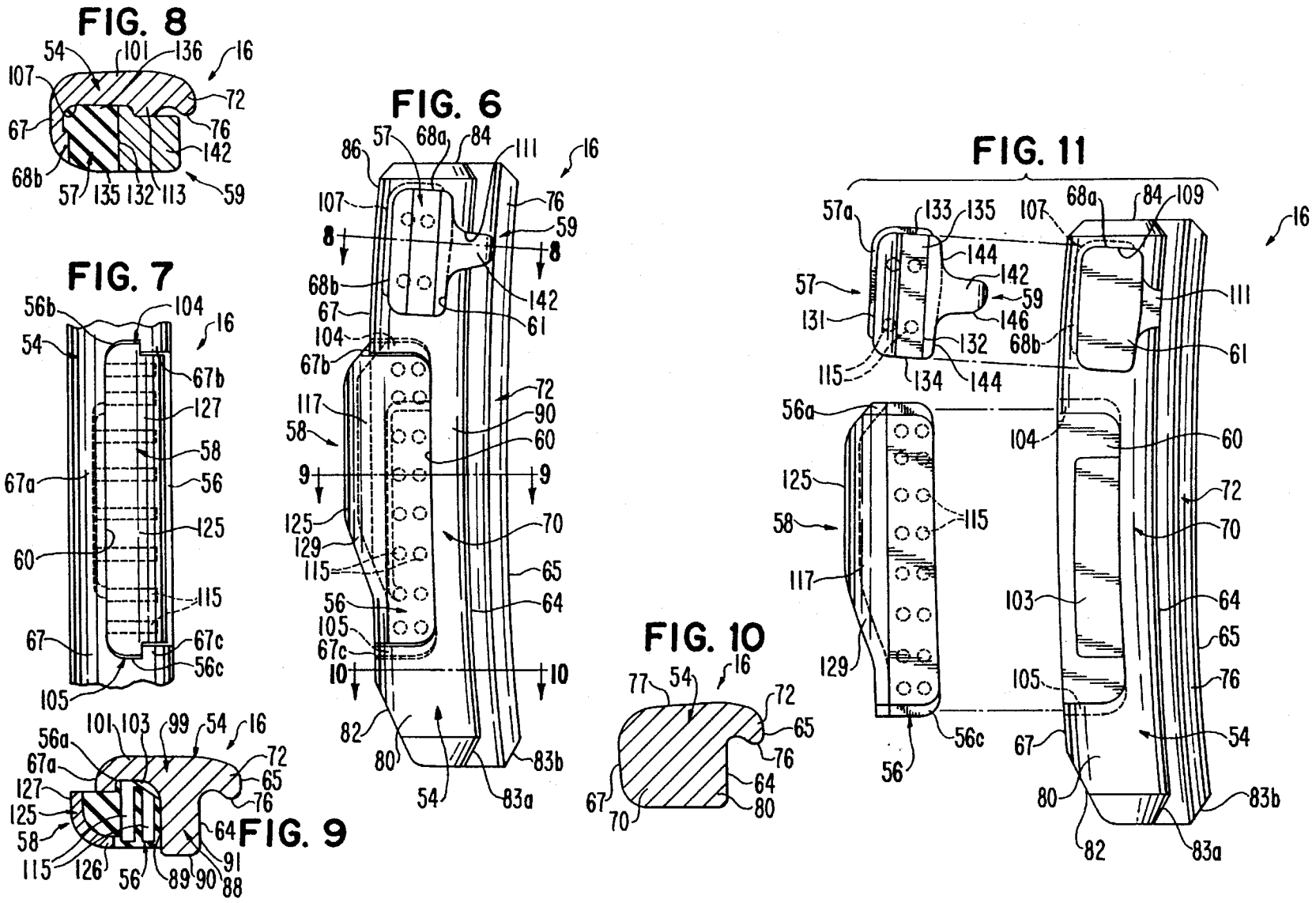
FIG. 6 is a side elevational view of the lock pin of the tooth.
FIG. 7 is a partial front elevational view of the lock pin.
FIG. 8 is a cross sectional view taken along line 8—8 in FIG. 6.
FIG. 9 is a cross sectional view taken along line 9—9 in FIG. 6.
FIG. 10 is a cross sectional view taken along line 10—10 in FIG. 6.
FIG. 11 is an exploded side view of the lock pin.

At the bottom 80 of pin 16, body segment 70 has a generally block-like configuration (FIGS. 6 and 10). A tapered section 82 is provided along the front wall 67 of the body to ease the assembly of the tooth, as discussed below. Chamfers 83*a*, 83*b* are also provided along the bottom of rear walls 64, 65, respectively, to facilitate easier insertion of the pin into opening 50. A flat striking face 84 is defined at the top 86 of pin 16. Face 84 is struck by a user to drive the pin into and out of opening 50.

A relatively large pocket 60 is defined along the midsection of pin 16 (FIGS. 6 and 9). In this section, casing 54 has a substantially T-shaped configuration. More specifically, body 70 includes a substantially rectangular base segment 88 having a front wall 89, a side wall 90 and a rear wall 91. Base segment 88, at an end opposite to side wall 90, intersects a transverse segment 99 defined by arm 72 and an inner sidewall 101. Sidewall 101 extends forwardly from base 88 and intersects with front wall 67 of pin 16. Front wall 67 defines a reduced portion 67a adjacent pocket 60. Front wall portion 67*a*, sidewall 101 and base segment 88 cooperate to define a shallow side cavity 103 for receiving a portion 56*a* of tightening elastomer 56. At the top and bottom of elastomer 56, front wall 67 and side wall 68 cooperate to define a pair of stop portions 67*b*, 67*c* which extend towards one another. The stop portions 67*b*, 67*c* each cooperate with the inner wall 102 of sidewall 101 to define shallow top and bottom cavities 104, 105 adapted to receive elastomer portions 56*b*, 56*c*. During manufacture of the pin, elastomer 56 is flexed and "popped" into pocket 60 and cavities 103–105. These cavities function to retain elastomer 56 in casing 54. In lieu of or in addition to the array of cavities 103–105, the elastomer may be bonded to the inner walls of the casing.

Casing 54 along the top 86 of pin 16 defines pocket 61 adapted to receive and retain locking elastomer 57 (FIGS. 6 and 8). Front wall 67 and inner sidewall 101 extend completely about pocket 61 in a substantially L-shaped configuration. Front wall 67 defines a shallow cavity 107 adjacent sidewall 101. Cavity 107 is also defined along the upper wall 109 of pocket 61 adjacent sidewall 101. As a result, cavity 107 has a generally L-shaped configuration which is bounded by front wall 67, sidewall 101, base segment 88 and stop portions 68*a*, 68*b*. Base segment 88 extends along the back of elastomer 57, except for a gap 111 which is defined at about the midsection of the elastomer. A portion of base segment 88 remains adjacent gap 111 to define a stop 113 for elastomer 57. Elastomer 57, like elastomer 56, is flexed and "popped" into the pocket where it is retained by the defined cavity and stops.

Elastomers 56, 57 are each composed of a resilient, relatively durable and strong material, such as polyurethane or rubber. Of course other materials having the requisite characteristics could also be used. Elastomers 56, 57 are each also preferably provided with a series of bores 115 to enhance the level of compression attainable by the elastomers (FIGS. 6–7, 9 and 11). The bores are preferably closed to prevent compaction of fines therein.

Tightening elastomer 56 has a generally elongate configuration (FIGS. 6–7, 9 and 11). A bulged portion 117 extends from the front of elastomer 56 to define with rigid plate 125 first protrusion 58. Protrusion 58 is placed in resilient engagement with ledge 22 of adapter nose 18 to tighten the attachment of the point on the nose. Additionally, elastomer 56 includes a side ridge 56*a*, a top ridge 56*b* and a bottom ridge 56*c* adapted for receipt into cavities 103, 104, 105, respectively. Plate 125 is preferably composed of a metallic material and has a generally bowed configuration defining two legs 126, 127 which overlie and are bonded or otherwise secured to the front and one side of elastomer 56. Plate 125 is further bowed in the vertical direction to extend over bulged portion 117. Plate 125 protects elastomer 56 from wearing due to its abutment against ledge 22 of adapter nose 18. Protrusion 58 includes a tapered section 129 to permit easier compression of elastomer 56 during insertion and removal of pin 16 into and from opening 50.

Locking elastomer 57 has a generally rectangular block-like configuration defined by a front wall 131, a rear wall 132, a top wall 133, a bottom wall 134 and side walls 135, 136 (FIGS. 6, 8 and 11). A ridge 57*a* extends along front and top walls 131, 133 to be received in cavity 107. A rigid detent 142 preferably composed of a metallic material is bonded or otherwise secured to rear wall 132 and projects through gap 111 in casing 54. Detent 142 in combination with elastomer 57 defines a second resiliently depressible protrusion 59. Detent 142 includes shoulders 144 adapted to abut casing 54 to provide a limit to the outward extension of the detent. Detent 142 has an arcuate bottom corner 146 which is provided to ease retraction of the detent when pin 16 is driven into and out of opening 50.

As mentioned above, lugs 28*a*, 28*b* are disposed rearwardly beyond rear wall 38 of point 12 (FIGS. 1–3 and 12). The lugs are joined to body 32 of point 12 by a rearwardly extending ear 44. Ear 44 merges with the top and bottom walls 34, 35 of point 12 along a broad arcuate transition portion 149*a*, 149*b* (FIGS. 2 and 12). Portions 149*a*, 149*b* are formed as broad arcuate portions (e.g., having a radius of curvature of about 19 mm/0.75 in. for a point body with a rear opening of 178 mm/7 in.) to minimize the stress levels at the interconnections under heavy loading. Transition portions defining sharper curvatures have been found to create stresses approaching unacceptably high levels during use of the point.

A portion of rear wall 38 of point 12 defining opening 50 includes a pair of bosses 155*a*, 155*b* in opposed relation with lugs 28*a*, 28*b*, respectively (FIGS. 1–3 and 13–15). Bosses 155*a*, 155*b* extend rearwardly toward inner faces 48*a*, 48*b* of lugs 28*a*, 28*b* to narrow the depth of opening 50 along portions 50*a*, 50*b*. Portions 50*a*, 50*b* of opening 50 matingly receive pin 16 during use, such that bosses 155*a*, 155*b* engage front wall 67 of pin 16 and inner faces 48*a*, 48*b* engage rear wall 64. The formation of bosses 155*a*, 155*b* requires a relatively sharp transition corner 157*a*, 157*b* between ear 44 and rear wall 38. Corners 157*a*, 157*b* each has a radius of curvature which is about 65 percent or less of the radius of curvature desired for transition segments 149*a*, 149*b*. In order to avoid disrupting the broad transition segments 149*a*, 149*b* connecting the upper and lower ends of ear 44 with top and bottom walls 34, 35 of point 12, bosses 155*a*, 155*b* are offset from the upper and lower ends of opening 50.

Lug 28*a* is further provided with a recess 151 along inner face 48*a* (FIGS. 1–3 and 13–15). Recess 151 is shaped to matingly receive detent 142 therein to securely hold lock pin 16 in opening 50. Accordingly, recess 151 includes an arcuate bottom surface 153 in engagement with corner 146 during use. The engaged sloped surfaces 146, 153 enable the retraction of detent 142 from recess 151 when pin 16 is driven from opening 50.

Lug 28*b* further defines a beveled surface 159 along its upper end which slopes forward and outward (FIGS. 3 and 13–15). Bevel 159 functions to ease the entry of the bottom portion 80 of pin 16 into the narrowed opening portion 50*b* during insertion of pin 16 into opening 50. Bevel 159 also acts to ease retraction of detent 142 in removal of pin 16 from opening 50.

Figures 13, 14, 15:
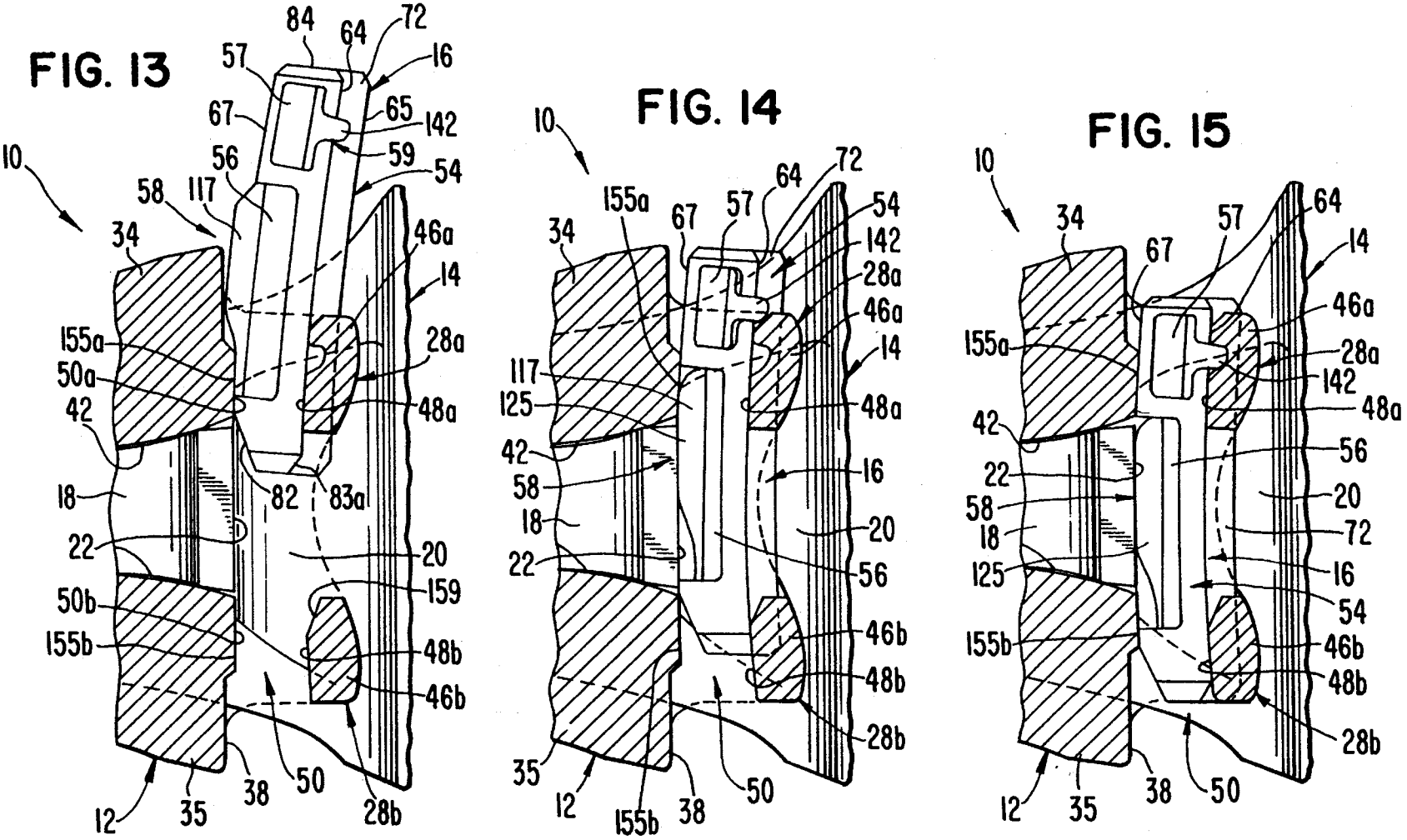
FIG. 13 is a cross sectional view taken along line 13—13 in FIG. 12 showing an initial step in a process for assembly of the pin info, tooth.
FIG. 14 is a cross sectional view taken along line 13—13 in FIG. 12 showing a medial step in the process for assembly of the pin into the tooth.
FIG. 15 is a cross sectional view taken along line 13—13 in FIG. 12 showing the assembled tooth.

To assemble tooth 10, point 12 is slipped over adapter nose 18 such that the nose is matingly received into socket 42 (FIGS. 12–15). Lugs 28*a*, 28*b* are received partially into keyway 20. Once point 12 is placed fully onto adapter nose 18, the bottom 80 of lock pin 16 is placed into the upper region of opening 50. Unlike many tight fitting assemblies of the prior art, pin 16 can be placed essentially vertically into opening 50 a considerable distance prior to having to strike the pin (FIG. 13). Narrowed opening portion 50*a* matingly receives the pin and holds it for striking. The tight fitting locking constructions of the prior art have required an individual to manually hold the pin while striking it with a sledge hammer. The present invention eliminates the need to manually hold the pin because the end 80 of pin 16 passes freely into opening 50*a* sufficiently to stabilize the pin before hammering is required.

Once pin 16 is initially placed in the upper region of opening 50 (FIG. 13), top face 84 of pin 16 is struck repeatedly with a sledge hammer or the like to drive pin 16 farther into opening 50. Tapered section 129 of protrusion 58 abuts against the upper edge of boss 155*a* to gradually compress elastomer 56 into casing 54 as the pin is driven downward. Elastomer 56 will be compressed as it travels through opening portion 50*a* until the outer surface of plate 125 is flush with front wall 67 of pin 16. Tapered segment 82 engages ledge 22 as the pin in driven downward and gradually moves the point rearward, as necessary, to make room for the full depth of pin 16. As pin 16 is driven farther into opening 50, chamfer 83*a* engages bevel 159 so that pin 16 is guided smoothly into opening portion 50*b* (FIG. 14). Likewise, arcuate bottom corner 146 of detent 142 engages an upper beveled corner 161 of lug 28*a* to ease the compression of locking elastomer 57 and retraction of detent 142. Detent 142 will retract completely into gap 111 as it passes over inner face 48*a* of lug 28*a*.

In the assembled position (FIG. 15), front wall 67 of pin 16 is engaged by bosses 155*a*, 155*b* and rear wall 64 is engaged by inner faces 48*a*, 48*b* to hold pin 16 to the point. This construction will hold pin 16 to point 12 irrespective of the longitudinal position of the point relative to adapter nose 18. Hence, as point 12 is shifted by jacking and other forces, pin 16 will shift with it. As can be appreciated, this construction reduces the likelihood that the shifting of the point will cause the pin to be ejected from opening 50.

In addition, plate 125 is positioned to press against ledge 22 of adapter nose 18 to ensure a tight engagement of point 12 on the nose. Elastomer 56 is illustrated in FIG. 15 in its most compressed position. In this position, ledge 22 is engaged by front wall 67 (i.e., portion 67*a*) as well as plate 125. Over-compression of elastomer 56 is thereby precluded by the presence of rigid casing 54. This construction therefore provides a certain level of protection for elastomer 56. As the parts begin to wear, the point fits more loosely on the adapter nose. Under these conditions, the point is pressed farther onto the nose such that ledge 22 is located forwardly of bosses 155*a*, 155*b*. Elastomer 56 then expands outward so that plate 125 continues to abut against ledge 22. This expansion can occur until elastomer 56 reaches its maximum expansion.

In the assembled position (FIG. 15), detent 142 is snapped into recess 151 defined in lug 28*a*. Rigid casing 54 substantially encapsulates elastomer 57 to isolate and shield it from heavy loading forces applied to the point. The prospect of overloading and causing the premature failure of elastomer 57 is therefore avoided. This separate locking construction virtually eliminates the risk of experiencing an unintended loss of the pin. Moreover, even if tightening elastomer 56 completely fails due to overloading or wearing, the combination of securing casing 54 in opening portions 50*a*, 50*b* and the receiving detent 142 in recess 151 prevents release of the pin.

When the point needs to be replaced, pin 16 is struck again on top face 84 to drive the pin downward. Typically a pointed tool is used in combination with a sledge hammer to drive the pin from opening 50. Arcuate corner 146 of detent 142 slides along the sloped bottom 153 of recess 151 to compress elastomer 57 and retract detent 142. As with the insertion of the pin, detent 142 will retract completely within gap 111 as it passes over inner face 48*a*. Similarly, detent 142 will also be retracted by bevel 159 for passage over inner face 48*b*.

In an alternative embodiment of the present invention (FIGS. 16–20), a tooth 170 includes a point 172, an adapter 174 and a modified locking pin 16'. Tooth 170 preferably has a construction similar to the tooth disclosed in U.S. Pat. No. 4,231,173 to Davis, which is incorporated herein by reference. Nevertheless, other center locking teeth constructions could be used.

Figure 19:
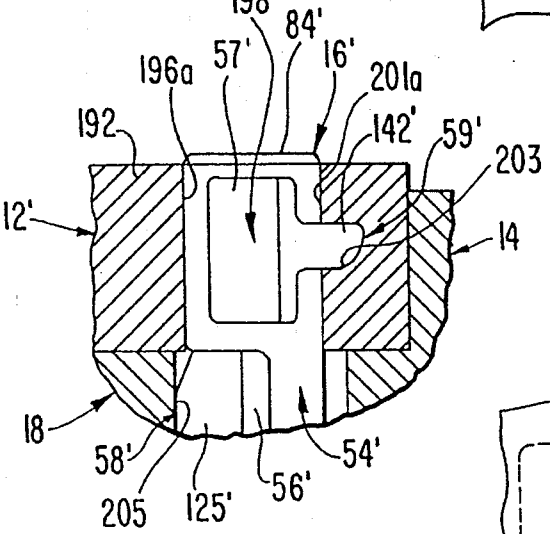
FIG. 19 is a partial cross sectional view of the assembled tooth taken along line 19—19 in FIG. 17.

Lock pin 16' has essentially the same construction as pin 16, except that arm 72 is preferably omitted and the casing 54 preferably has a straight configuration (FIGS. 16 and 19). As discussed above, arm 72 was designed to extend between lugs 28*a*, 28*b* and side wall 24. Since this arrangement is absent in the center locking tooth, arm 72 is omitted. Nevertheless, a slot could be defined in the point and the adapter nose to accommodate the use of an arm. In the preferred construction, the side walls defining the aligned central openings prevent unwanted turning of the pin. For ease of discussion, the same reference numerals as were used to describe pin 16—with the addition of a prime—will be used in connection with pin 16'.

Figure 17:
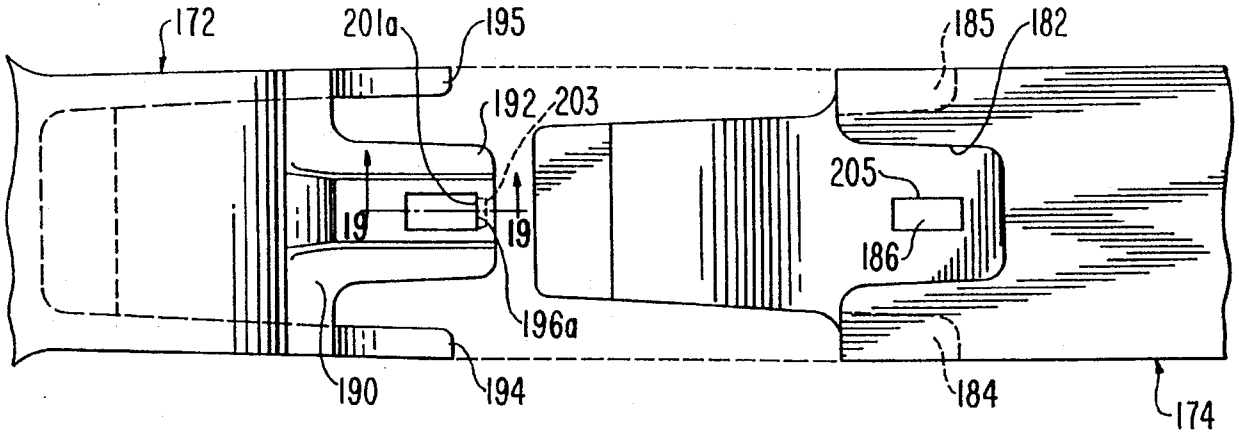
FIG. 17 is an exploded, partial top plan view of the point and adapter nose of the second embodiment.
Figure 18:
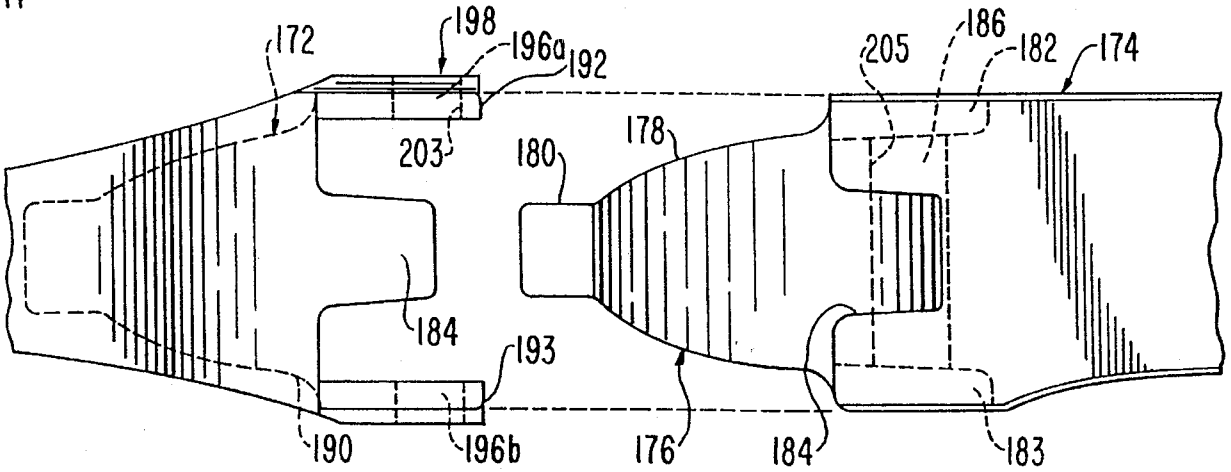
FIG. 18 is an exploded, partial side elevational view of the point and adapter nose of the second embodiment.

Adapter 174 includes a shank (not shown) adapted to be secured to the front lip of a bucket (not shown) (FIGS. 16–18). Adapter 174 further includes a forwardly projecting nose 176 having a conical portion 178 and a distal box portion 180. Adapter 174 defines a top recess 182, a bottom recess 183, and a pair of side recesses 184,185. A bore 186 having a generally rectangular shape is defined to extend through the adapter nose and open in the top and bottom recesses 182, 183.

Point 172 includes a front digging edge 188 and a rear end 190 defining a rearwardly opening socket 191 shaped to matingly receive adapter nose 176. A top ear 192, a bottom ear 193, and a pair of side ears 194, 195 extend rearwardly from rear end 190. When the tooth is assembled, top ear 192 is received in top recess 182, bottom ear 193 is received within bottom recess 183, and side ears 194, 195 are received within side recesses 184, 185. Top and bottom ears 192, 193 each define an aperture 196*a*, 196*b* which is aligned with the other. When point 172 is assembled onto adapter nose 176, apertures 196*a*, 196*b* are substantially aligned with bore 186 in nose 176 to define a pin opening 198. The rear face 201*a* of aperture 196*a* in top ear 192 additionally defines a recess 203 adapted to matingly receive detent 142' of pin 16'.

During use, pin 16' is received into opening 198 such that the bottom and top portions 80', 86' of casing 54' are matingly received into apertures 196*a*, 196*b* of point 172. In this way, lock pin 16' is held independently of the longitudinal position of point 12 on adapter nose 176. Protrusion 58' engages and presses against the front wall 205 of bore 186 to tighten the connection of the point on the adapter nose. Elastomer 57' presses detent 142' into recess 203 to independently secure pin 16' to point 172. This construction provides the same protection against pin loss as discussed above in regard to tooth 10.

Figure 21:
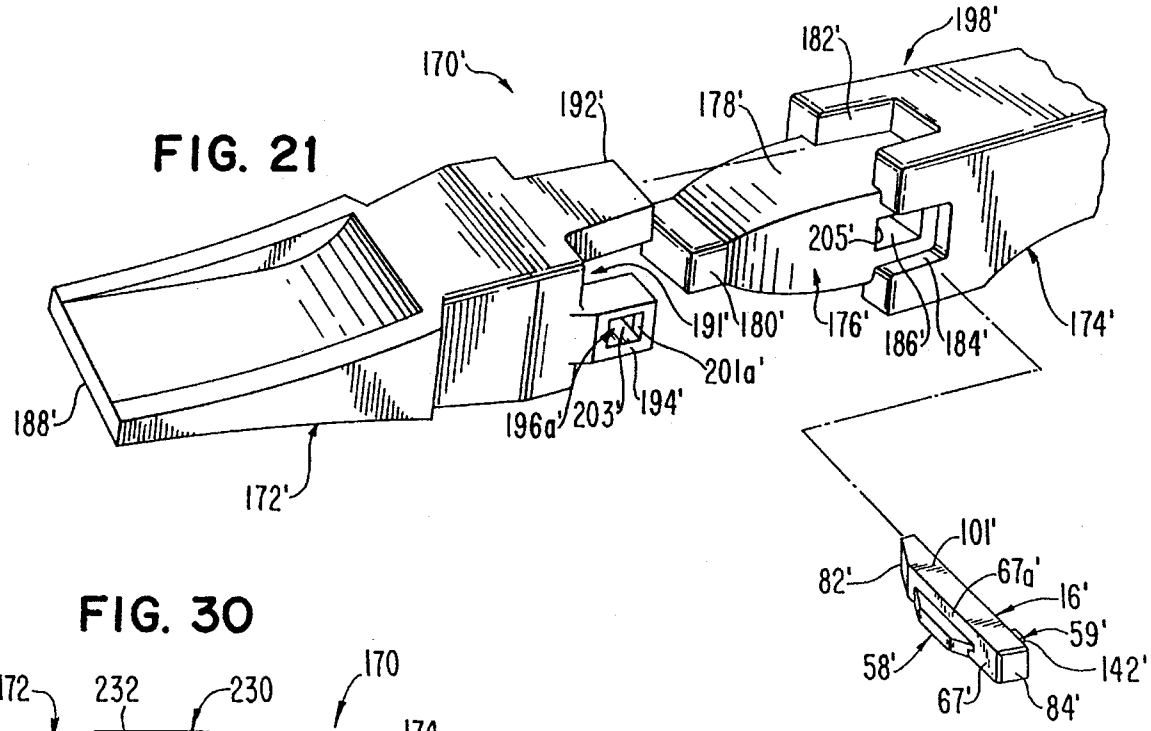
FIG. 21 is an exploded, partial perspective view of a third embodiment of the present invention.

Pin 16' can also be used in conjunction with an excavating tooth 170' having a side locking construction (FIG. 21). In accordance with this embodiment, tooth 170' is comprised of a point 172', an adapter 174' and a lock pin 16'. The point and adapter of tooth 170' have essentially the same shape as the point and adapter of tooth 170, except for the formation of the apertures adapted to receive the lock pin. Of course, pin 16' could be used with other teeth having different side locking constructions. In view of the similarity of the two embodiments, the same reference numerals with the addition of a prime have been used to designate like parts of the point and adapter. The lock pin 16' used with this embodiment is the same as used with tooth 170.

According to this embodiment, adapter 174' includes a forwardly projecting nose 176' having a conical portion 178' and a box portion 180'. Adapter nose 176' further defines a top recess 182', a bottom recess (not shown), and two side recesses 184' (only one of which is shown). Nose 176' further includes a horizontal opening 186' (i.e., parallel with the bucket lip) sized and shaped to receive lock pin 16'. Consequently, opening 186' is positioned to open in the side recesses 184', rather than the top and bottom recesses as with point 170.

Point 172' includes a front digging edge 188' and a rearwardly opening socket 191' adapted to mating receive therein adapter nose 176'. Point 172' further includes an ear 192'–195' along each of the top, bottom and side walls of the point (only two ears 192', 194' are shown). Ears 192'–195' are matingly received into the corresponding recesses of adapter nose 176'. Openings 196*a'*, 196*b'* are defined in side ears 194', 195' (only 194' is shown) such that they are aligned with each other. The rear face 201*a'* of opening 196*a'* defines a locking recess 203' adapted to matingly receive detent 142' of pin 16'.

When point 172' is mounted on adapter nose 176', openings 196*a'*, 196*b'* are substantially aligned with opening 186'. Pin 16' is driven into the aligned openings 186', 196*a'*, 196*b'* so that first protrusion 58' resiliently engages front wall 205' of nose 176' and the ends of casing 54' are matingly received in openings 196*a'*, 196*b'*. In addition, detent 142' of second protrusion 59' is received into recess 203' to secure pin 16' to point 172'. As can be appreciated, this construction alleviates pin loss in the same way as discussed above for the earlier embodiments.

In another alternative embodiment (FIGS. 22–25), a tooth 10' is comprised of a point 12', an adapter 14 and a lock pin 16". The adapter in this tooth has the same construction as in tooth 10; hence, the same reference numerals are used. Point 12' is substantially the same as point 12; hence the same reference numerals with the addition of a prime have been used to designate like parts. Lock pin 16" is substantially the same as lock pin 16; hence, the same reference numerals with the addition of a double prime have been used to designate like parts.

In this embodiment, lock pin 16" preferably includes a few structural variations with respect to pin 16. In particular, casing 54" has a linear configuration similar to pin 16'. In addition, arm 72" has a rectangular configuration with inner and outer sides 77', 207 abutting nose 18 and lugs 28*a'*, 28*b'*, respectively. First protrusion 58" has an arcuate convex configuration which engages against ledge 22 of nose 18. Despite these changes, these elements of pin 16" could have the same configurations as pin 16.

In contrast to pin 16, lock pin 16" includes a pair of locking elastomers 210*a*, 210*b*. Elastomers 210*a*, 210*b* each have a central body portion 212*a*, 212*b* and a pair of oppositely projecting extension portions 213*a*, 213*b*, 214*a*, 214*b*. Rigid detents 217*a*, 217*b*, 218*a*, 218*b* are bonded or otherwise secured to the ends of extension portions 213*a*, 214*a*, 213*b*, 214*b* to form a plurality of the locking protrusions 222*a*, 222*b*, 223*a*, 223*b*. During use, locking protrusions 223*a*, 223*b* extend rearwardly through gaps 111*a*, 111*b* defined in rear wall 64" of casing 54" for mating receipt of detents 218*a*, 218*b* within recesses 151*a*, 151*b*. Locking protrusions 222*a*, 222*b* extend forwardly through gaps 219*a*, 219*b* in front wall 67" of casing 54" so that detents 217*a*, 217*b* engage recesses 221*a*, 221*b* defined along the outer edges of bosses 155*a*', 155*b*'. Recesses 221*a*, 221*b* do not fully encapsulate detents 217*a*, 217*b* in the same way as recesses 151*a*, 151*b* enclose detents 218*a*, 218*b*. Instead, the outer portions of detents 217*a*, 217*b* are left open so that the broad arcuate transition portions 149*a*', 149*b*' remain undisturbed. Detents 217a, 217b therefore cooperate to grip bosses 155*a*', 155*b*' therebetween and hold pin 16" to point 12'.

As evidenced with this embodiment, many variations can be employed without departing from the spirit of the invention. For example, one or more locking elastomers may be used. The locking elastomers may cooperate with detents to form locking protrusions which extend forwardly, rearwardly, transversely or in a combination of these directions. The shapes of the casings and elastomers may of course be varied. Moreover, lock pin 16" may also be used to assemble center locking teeth 170 and side locking teeth 170'. In these arrangements, the points 172, 172' define additional locking recesses to receive each of the projecting detents.

In another alternative embodiment (FIGS. 26–29), a tooth 10" is comprised of a point 12", an adapter 14 and a lock pin 230. The adapter in this tooth has the same construction as in tooth 10; hence, the same reference numerals are used. Point 12" is substantially the same as point 12; hence the same reference numerals with the addition of a double prime have been used to designate like parts. Lock pin 230 is particularly adapted for smaller sized pins, wherein a sufficiently sized separate locking elastomer is not feasible. Nevertheless, pin 230 would also have applicability in larger sizes of teeth.

Lock pin 230 is comprised of a rigid casing 232 and a single elastomeric member 234. Elastomer 234 is received within a pocket 254 defined in casing 232. Elastomer 234 includes a forwardly extending tightening portion 236 and a rearwardly extending locking portion 237. A rigid plate 261 is bonded or otherwise secured to tightening portion 236 of elastomer 234 to define a first protrusion 238 which projects forwardly to resiliently abut against ledge 22 of adapter nose 18. Similarly, a rigid detent 263 is bonded or otherwise secured to locking portion 237 to define a second protrusion 239. Second protrusion 239 is adapted for mating receipt within a gap 240 defined between lugs 28*a*", 28*b*" to secure pin 230 to point 12". Protrusions 238, 239 therefore extend in opposite directions and are independently depressible. This independent action of the protrusions functions to reduce the likelihood of pin loss due to overloading, jacking forces or wear to the adapter nose. The independently depressible nature of the rear protrusion provides a secure locking function to alleviate unintended pin loss, isolates the rear protrusion from the front protrusion to lessen the effects of heavy loading, and enhances the mating receipt of the pin's rigid casing in the pin opening of the point to securely lock the pin to the point even when assembled on a worn and loose fitting adapter nose.

Casing 232 is an elongated rigid member preferably composed of a rigid metallic material. Casing 232 preferably has a slightly arcuate configuration, such that front wall 241 has a convex shape and rear walls 243,244 have a concave shape. The arcuate shape of pin 230 permits it to be used with current points. Casing 232 could however be formed with a linear shape. Casing 232 has a body 249 and an arm 250 which projects rearwardly along the inner side 252 of casing 232. Arm 250 preferably has a hook-like configuration which includes an inner face 251 and an end face 253. Arm 250 extends between nose 18 and lugs 28*a*", 28*b*" such that inner face 251 engages side wall 24 of keyway 20 and end face 253 engages inner faces 74*a*", 74*b*" of lugs 28*a*", 28*b*". Arm 250 thereby stabilizes pin 230 against unwanted turning and prevents the erroneous insertion of pin 230 into the defined pin opening 50".

The top and bottom ends 247, 248 of casing 232 each have a generally block-like construction defined by a front wall 241, a rear wall 243 and side walls 245, 246. A flat striking wall 242 is formed at the top 247 of casing 232. Small chamfers 265–267 are defined along the bottom end 248 of casing 232 to facilitate easy insertion of pin 230 into opening 50". Chamfer 265 further engages the upper end of ledge 22 during the pin's insertion to shift, as necessary, point 12" farther onto adapter nose 18. Chamfer 266 further engages the corner of lug 28*b*" to ease the passage of bottom end 248 between rear wall 38" and lug 28*b*". Chamfers 265–267 may be formed larger if deemed necessary for the particular operation.

Figure 26:
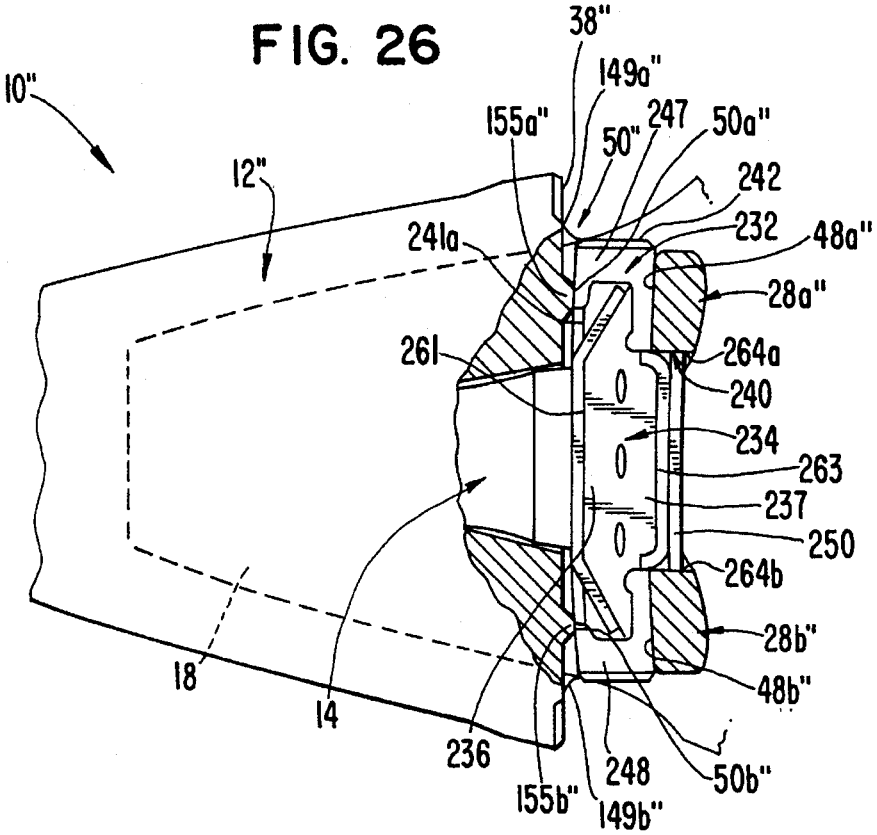
FIG. 26 is a partial cross sectional view taken in the position of line 13—13 of FIG. 12 of a tooth in accordance with a fifth embodiment of the invention.

Pocket ends 254*a*, 254*b* of pocket 254 are adapted to hold elastomer 234. The medial portion of front wall 241 includes a reduced portion 241*a* which defines an opening 256 through which first protrusion 238 projects. Wall portion 241*a* extends along side of protrusion 238 so that wall 241*a* engages ledge 22 of nose 18 at a certain point of elastomer compression. Wall portion 241*a* thereby protects tightening portion 236 of elastomer 234 from undue compression. FIG. 26 illustrates the elastomer 234 at a point of maximum compression. As adapter nose 18 wears, point 12" will be mounted farther onto the nose. Under these circumstances protrusion 238 will expand to maintain engagement with ledge 22. Plate 261 of protrusion 238 preferably has a central segment 261*a* to engage ledge 22 and a pair of receding end segments 261*b*, 261*c*. End segments 261*b*, 261*c* are tapered to permit easy retraction of protrusion 238 into casing 232 as the pin is driven into and out of opening 50".

Figure 27:
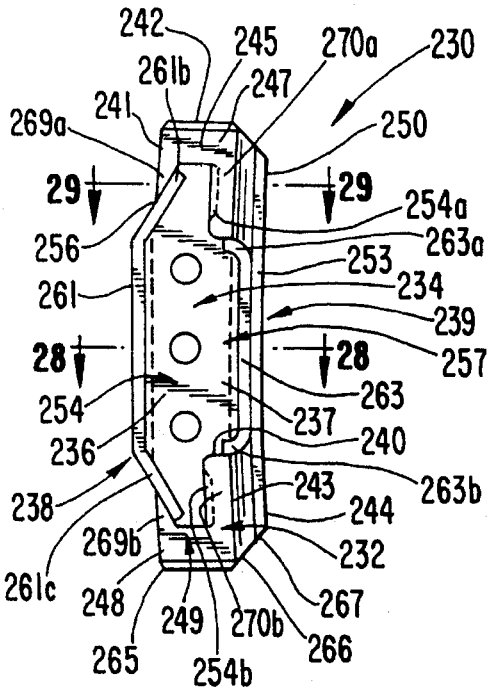
FIG. 27 is a side elevational of the lock pin of the fifth embodiment.
Figure 28:
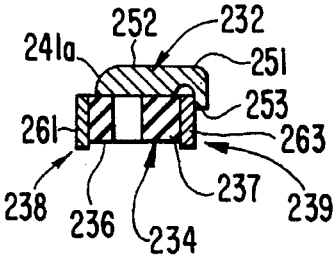
FIG. 28 is a cross sectional view taken along line 28—28 in FIG. 27.
Figure 29:
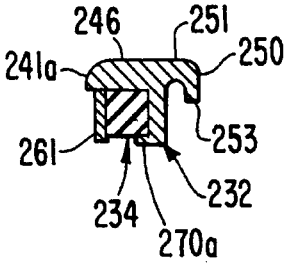
FIG. 29 is a cross sectional view taken along line 29—29 in FIG. 27.

Rear wall 243 of casing 232 likewise defines an opening 257 through which locking protrusion 239 projects. Detent 263 of protrusion 239 has a generally C-shaped configuration. Ends 263*a*, 263*b* of detent 263 are abuttingly engaged against ends 264*a*, 264*b* of lugs 28*a*", 28*b*". Ends 263*a*, 263*b* of the detent are rounded to ease the compression of locking portion 237 and the retraction of detent 263 during insertion and removal of the pin. Angled portions could be used in place of rounded ends. Since significant levels of pressure are not applied to second protrusion 239 during use, over compression of locking portion 237 of elastomer 234 is not an issue. As seen in FIG. 27, arm 250 limits the outward extension of detent 263 to ensure that ends 263*a*, 263*b* of the rigid detent remain in contact with both casing 232 and lugs 28*a*", 28*b*".

Portions 269*a*, 269*b*, 270*a*, 270*b* of casing 232 along sidewall 245 form pocket ends 254*a*, 254*b* of pocket 254 to define stops which function to retain elastomer 234 in the pocket. Elastomer 234 is preferably flexed and "popped" into pocket 254 during manufacture of the pin. The elastomer could however be bonded along the inner rear face 272 of pocket 254. Elastomer 234 is composed of a relatively strong and durable resilient material, such as polyurethane or rubber. Of course other suitable materials could be used. In addition, elastomer 234 may, but need not, include internal bores 259 to enhance its resiliency. Bores 259 may be closed if desired.

During use, first protrusion 238 resiliently presses against ledge 22 of adapter nose 18 to tighten the connection of point 12" onto the nose. Detent 263 of second protrusion 239 is matingly fit between the opposed ends 264*a*, 264*b* of lugs 28*a"* and 28*b"*, respectively. As can be appreciated, detent 263 engages lugs 28*a"*, 28*b"* to securely hold pin 230 to point 12". This independent locking of pin 230 to the point reduces the risk of pin loss due to overloading of tightening portion 236, jacking forces or wear to the adapter nose.

In addition, pin 230 is held by point 12", irrespective of the longitudinal position of point 12" on adapter nose 18. Specifically, bosses 155*a"*, 155*b"* are formed on rear wall 38" to define narrowed opening portions 50*a"*, 50*b"* which matingly receive and hold top and bottom ends 247, 248 of casing 232. Casing 232 is held between lugs 28*a"*, 28*b"* and rear wall 38" such that front wall 241 is engaged by bosses 155*a"*, 155*b"* and rear wall 243 is engaged by inner faces 48*a"*, 48*b"* of the lugs. Bosses 155*a"*, 155*b"* are offset from the top and bottom ends of ear 44" in order to avoid disturbing the broad arcuate transition portions 149*a"*, 149*b"* connecting ear 44" to top and bottom walls 34", 35". The pin therefore moves integrally with the point and thus reduces the likelihood of ejecting the pin due to jacking forces or wear to the adapter nose. The locking receipt of detent 263 in gap 240 further acts to securely hold pin 230 to the point and avoid unwanted loss of the pin.

To assemble the tooth, adapter nose 18 is matingly received into socket 42". Pin 230 is manually set into opening 50" so that the bottom 248 of casing 232 is matingly held in reduced portion 50*a"*. As pin 230 is driven downward, protrusion 238 will be retracted by boss 155*a"* and protrusion 239 will be lug 28*a"*. As the protrusions pass over boss 155*a"* and lug 28*a"* (or boss 155*b"* and lug 28*b"* during removal) they are completely retracted into casing 232. When pin 230 reaches its desired position, protrusion 238 expands to engage ledge 22 and protrusion 239 snaps into gap 240.

Figure 30:
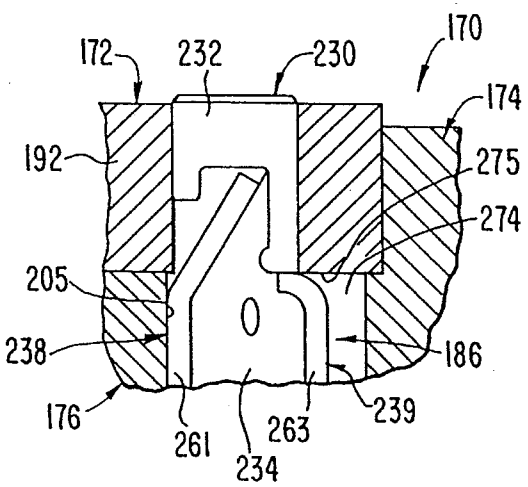
FIG. 30 is a partial cross sectional view taken in the position of line 19—19 in FIG. 18 of a sixth embodiment of the invention.
Figure 22:
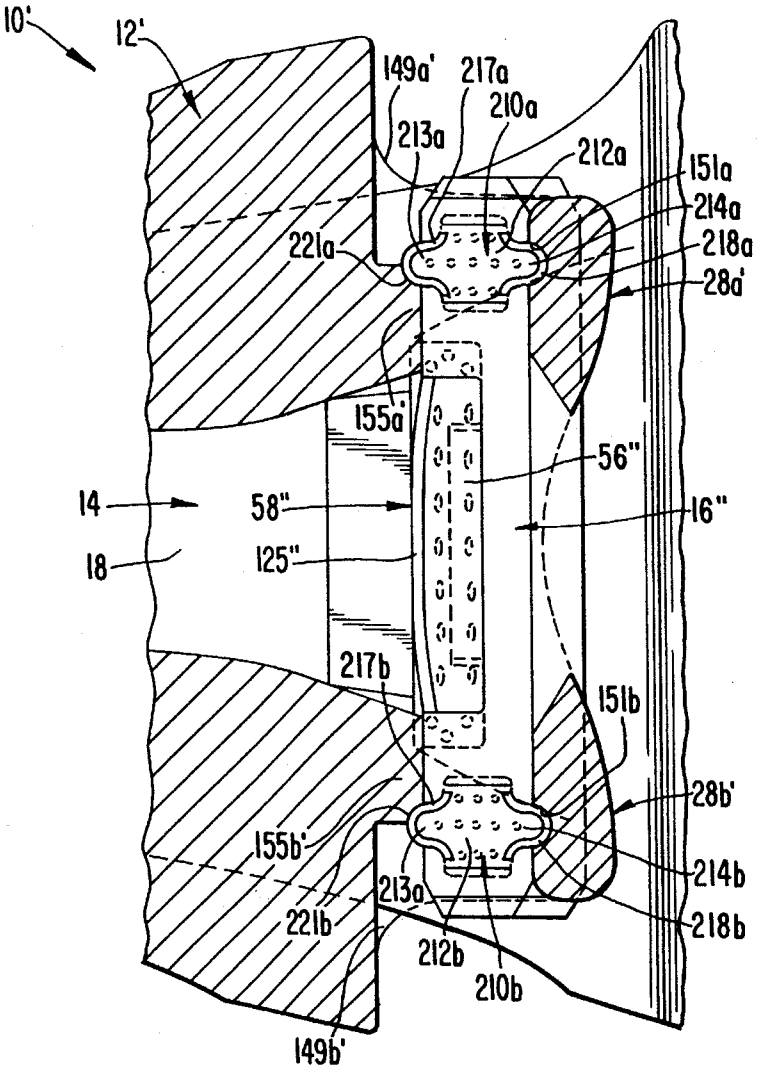
FIG. 22 is a cross sectional view taken in the position of line 13—13 in FIG. 12 of a tooth in accordance with a fourth embodiment of the invention.
Figure 24:
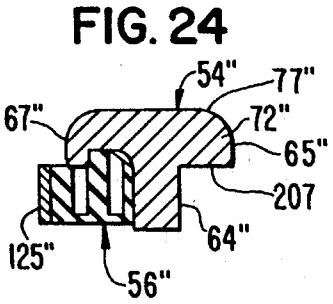
FIG. 24 is a cross sectional view taken along line 24—24 in FIG. 23.
Figure 25:
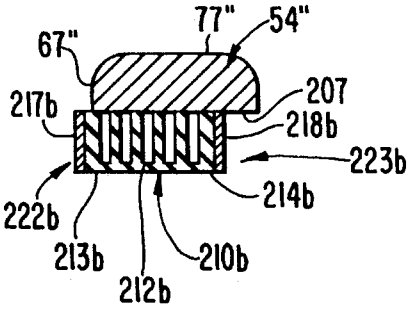
FIG. 25 is a cross sectional view taken along line 25—25 in FIG. 23.
Figure 23:
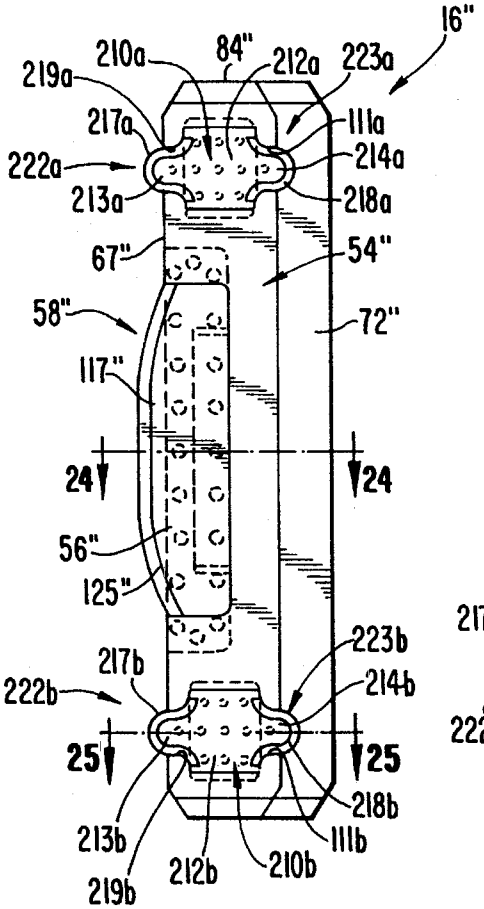
FIG. 23 is a side elevational view of the lock pin of the fourth embodiment.

Pin 230 may also be used in connection with a tooth having a center locking construction (FIG. 30) or a side locking construction (not shown), such as teeth 170, 170'. When used with these type of teeth, first protrusion 238 resiliently presses against the front wall 205 of opening 186 defined in adapter nose 18. Detent 263 is received into a gap 274 defined between the opposed outside ends 275 of top and bottom ears 192, 193 of the point. (The gap would be defined between the side ears 184' in a side locking tooth.) Opening 186 is formed of sufficient depth to accommodate the rearward extension of detent 263 into gap 274. The top and bottom ends 247, 248 of casing 232 are matingly received and held in openings 196*a*, 196*b* in ears 192, 193. Also, as with pin 16', arm 250 of pin 230 is preferably omitted.

In the preferred construction of a lock pin utilizing a single elastomer (FIGS. 31–35), the lock pin 300 includes an inner partition 302. More specifically, lock pin 300 comprises a rigid casing 304 and an elastomer 306. A pocket or recess 308 is defined in the central portion of the casing for receiving and retaining elastomer 306. Partition 302 is a rigid wall formed as one piece with casing 304 (FIG. 33). Partition 302 extends transversely in pocket 308 from an internal wall 309 of casing 304. As with the earlier embodiments, lock pin 300 includes a pair of independently depressible protrusions 310, 311.

Figure 31:
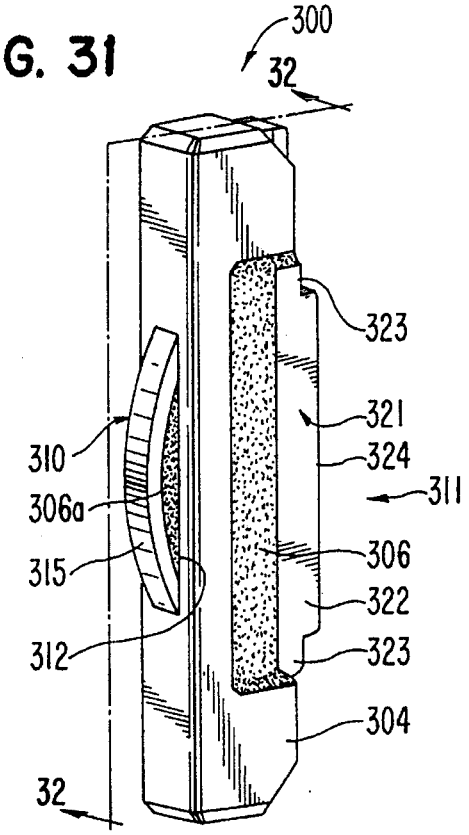
FIG. 31 is a perspective view of pin in accordance with a seventh embodiment of the invention.
Figure 32:
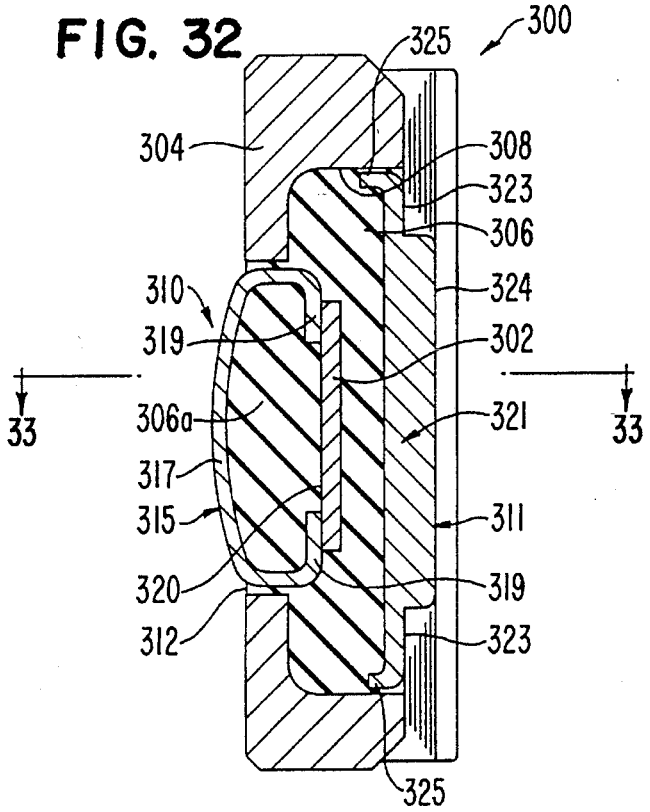
FIG. 32 is a cross sectional view taken along line 32—32 in FIG. 31.
Figure 33:
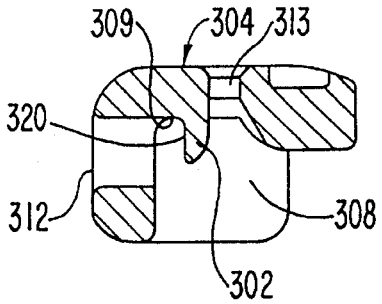
FIG. 33 is an enlarged cross sectional view taken along line 33—33 in FIG. 32, which only illustrates the casing.

The front protrusion 310 is formed by elastomer 306 and an overlying flexible loop member 315 (FIGS. 31–32). Loop member 315 encompasses a forward portion 306*a* of elastomer 306 and projects through a front opening 312 in the casing. The loop member is preferably composed of spring steel, but could be formed of other materials having the requisite characteristics of strength, flexibility and durability. The elastomer is preferably rubber which is injected through bore 313 under heat and pressure into pocket 308 (FIG. 33). The rubber is then cured in the assembled pin. Other elastomeric materials could also be used.

Loop member 315 has a front arcuate segment 317 and a pair of inwardly directed feet 319 (FIGS. 31–32). The feet 319 lie against a front face 320 of partition 302 to provide enhanced support for the front protrusion 310 and to better ensure independent action by the two protrusions. In use, protrusion 310 applies a tightening force on the adapter by the combined resilient flexing of loop member 315 and elastomer 306. Loop member 315 and elastomer 306 are sufficiently flexible to enable protrusion 310 to be completely received within pocket 308 to thereby facilitate insertion of the pin and protect against overloading.

Figure 34:
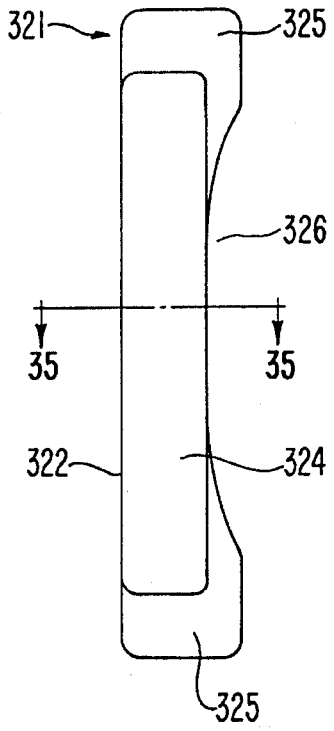
FIG. 34 is a rear elevational view of the rear detent.
Figure 35:
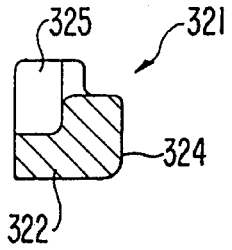
FIG. 35 is an cross sectional view taken along line 35—35 in FIG. 34.

The rear protrusion 311 is formed by elastomer 306 and a rear detent 321 (FIGS. 31–32 and 34–35). Detent 321 is a rigid, metallic member which is adhered or otherwise secured to elastomer 306. Detent 321 has a body 322 which is generally L-shaped and a pair of ends 323. The rearward portion 324 of body 322 defines a projection adapted for receipt within the gap defined between two opposing walls of the point, such as two opposed lugs in an external locking arrangement, to lock the pin to the point. The ends 323 of detent 321 are provided with relatively narrow flanges 325 which extend into elastomer 306 to attach detent 321 to elastomer 306 (FIGS. 32 and 35). Detent 321 is further provided with a cutout 326 on its inner side (FIG. 34). Cutout 326 provides clearance for partition 302 as the rear protrusion 311 is compressed. Nevertheless, a certain amount of overlap between detent 321 and partition 302 can be tolerated. As with the front protrusion, rear protrusion 321 can be received completely within pocket 308 to facilitate insertion of the pin and prevent overloading of the elastomer.

Lock pin 300 is illustrated to have a linear configuration. Nevertheless, the lock pin can alternatively be formed to have an arcuate shape. Lock pin 300 can also be used in an external, center or side locking construction in the same way as discussed for lock pin 230.

The above discussion concerns the preferred embodiments of the present invention. Various other embodiments as well as many changes and alterations may be made without departing from the spirit and broader aspects of the invention as defined in the claims.

We claim:

1. An excavating tooth comprising:

an adapter including a base adapted to be secured to excavating equipment and a forwardly extending nose, said adapter further including an opening;

a point including a front digging edge, a rearwardly opening socket receiving said adapter nose therein, a first opening in substantial alignment with said adapter opening, and a second opening proximate to said first opening; and a pin received into said adapter opening and said first opening of said point to securely couple said point to said adapter, said pin including a rigid casing and a plurality of independently depressible protrusions, each of said protrusions including a working member attached to elastomeric material, one of said protrusions being resiliently engaged and pressed against a wall defining a portion of said adapter opening to tighten said connection of said point to said adapter, and one other of said protrusions being resiliently engaged within said second opening of said point to lock said pin to said point.

2. An excavating tooth in accordance with claim 1 in which said adapter opening is defined by a keyway extending along one side of said adapter, and in which said first opening of said point is defined by a pair of spaced apart rearwardly disposed lugs along one side of said point.

3. An excavating tooth in accordance with claim 2 wherein said point further includes a body having a rear wall in which said socket opens, wherein said lugs each include a face in opposed relation to said rear wall, and wherein said second opening of said point is a recess defined in one of said faces of said lugs.

4. An excavating tooth in accordance with claim 2 wherein said second opening of said point is a gap defined between said spaced apart lugs.

5. An excavating tooth in accordance with claim 2 wherein said point further includes a body having top and bottom walls, a pair of sidewalls and an ear interconnecting said lugs to said body, wherein said ear interconnects with one said sidewall adjacent said top and bottom walls via a relatively broad arcuate transition segment, wherein said first opening of said point includes a plurality of spaced apart bosses such that each said lug is in opposed relation to one of said bosses to define a pair of opening portions of reduced depth to matingly receive and hold said casing of said pin therein, and wherein said bosses are offset from said broad arcuate transition segments.

6. An excavating tooth in accordance with claim 1 in which said adapter opening is defined by a hole extending through a central part of said adapter, and in which said first opening of said point is defined by a hole extending through each of a pair of spaced apart walls of said point.

7. An excavating tooth in accordance with claim 6 in which said second opening is a recess defined in a wall defining one of said holes in said point.

8. An excavating tooth in accordance with claim 6 in which said second opening is a gap defined between said spaced apart walls of said point.

9. An excavating tooth in accordance with claim 1 in which said casing of said pin is matingly received and held in at least a portion of said first opening of said point.

10. An excavating tooth in accordance with claim 1 in which said point further includes a plurality of second openings and said pin includes a plurality of said other protrusions, wherein each of said other protrusions is received within one of said second openings to securely lock said pin to said point.

11. An excavating tooth in accordance with claim 1 in which said pin further includes a plurality of independent elastomeric members, wherein one of said elastomeric members is attached to said working member of said one protrusion and one other of said elastomeric members is attached to said working member of said other protrusion.

12. An excavating tooth in accordance with claim 11 wherein said rigid casing of said pin substantially encapsulates said other of said elastomeric members to shield said other elastomeric member from forces applied to said point.

13. An excavating tooth in accordance with claim 1 in which said pin includes a single elastomeric member to which said working members of each said protrusion is attached.

14. An excavating tooth in accordance with claim 13 in which said working members of each said protrusion are depressible in opposite directions.

15. A point for an excavating tooth comprising a top wall, a bottom wall, a pair of side walls and a rear wall, said top and bottom walls being generally inclined towards one another to define a front digging edge, said point further including a socket opening in said rear wall to matingly receive a nose of an adapter, said point further including at least two spaced apart sets of opposed faces, each set of opposed faces defining a first opening in said point, said first openings being aligned with one another to receive a lock pin therein, each said set of opposed faces including a front face facing away from said digging edge and a rear face facing toward said digging edge and in opposed relation to said front face, at least one of said front and rear faces of at least one of said sets of opposed faces further including a recess for receiving a detent from the lock pin received therein.

16. A point in accordance with claim 15 which further includes a pair of spaced apart lugs, wherein said lugs are disposed rearwardly of one of said side walls beyond said rear wall, and wherein each of said rear faces are defined by one of said lugs and each of said front faces are defined by said rear wall.

17. A point in accordance with claim 16, in which at least one of said rear faces includes a recess adapted to receive a detent of the lock pin therein.

18. A point in accordance with claim 17 in which at least one of said front faces includes a recess in opposed relation to said recess defined in at least one of said rear faces, wherein each of said recesses defined in said front and rear faces is adapted to receive a detent of the lock pin therein.

19. A point in accordance with claim 16 which further includes an ear structure substantially aligned with one of said side walls and extending beyond said rear wall to connect said lugs to said side wall, and in which each of said lugs extends inwardly at a substantially right angle to said ear structure.

20. A point in accordance with claim 15 wherein one of said sets of opposed faces is defined in each of said top wall and said bottom wall.

21. A point in accordance with claim 15 wherein one of said sets of opposed faces is defined in each of said side walls.

22. A point for an excavating tooth comprising:

a body, a pair of spaced apart lugs, and an ear structure connecting said lugs to said body;

said body having a top wall, a bottom wall, a pair of side walls and a rear wall, said top and bottom walls being generally inclined towards one another to define a front digging edge, said body further including a socket opening in said rear wall to matingly receive a nose of an adapter;

said lugs being disposed rearwardly of one of said side walls beyond said rear wall, each of said lugs including a face disposed in opposed relation to said rear wall, said faces of said lugs being spaced from said rear wall to define an opening therebetween;

said ear being interconnected to said body at said top and bottom walls via a broad arcuate transition segment in order to maintain acceptable levels of stress at the interconnection under heavy loading; and said rear wall defining a boss in opposed relation to said face of each said lug, each of said bosses being offset from said broad arcuate transition segments and defining a narrower portion of said opening adapted to matingly receive and hold a lock pin therein.

23. A point in accordance with claim 22 in which said face of at least one of said lugs further includes a recess adapted to receive a detent of a lock pin therein to thereby lock the lock pin to said point.

24. A point in accordance with claim 23 in which said face of each said lug includes a recess adapted to receive a detent of the lock pin therein.

25. A point in accordance with claim 22 in which at least one of said bosses includes a recess adapted to receive a detent of a lock pin therein to thereby lock the lock pin to the point.

26. A lock pin for coupling a point to an adapter to form an excavating tooth, said lock pin comprising an elongate rigid casing having a one piece construction which rigidly resists external forces applied during use and a plurality of independently depressible protrusions, each said protrusion including a working member attached to elastomeric material, said casing including at least one pocket for receiving and mounting said elastomeric material therein, said casing having a first gap therein through which one of said protrusions extends to engage a face of an adapter in order to tighten the connection of a point on an adapter, said casing having a second gap therein through which another of said protrusions extends to engage an opening in the point to lock said lock pin to the point, each of said working members being movable between a point of maximum expansion and a point of maximum compression for said respective elastomeric material, outer walls of said casing which are fixed relative to one another being located between said points of maximum expansion and maximum compression for said one protrusion and between said points of maximum expansion and maximum compression of said another protrusion whereby said casing protects said elastomeric material against undue compression.

27. A lock pin in accordance with claim 26 in which said working members are attached to a single unitary elastomeric member.

28. A lock pin in accordance with claim 26 in which said elastomeric material is comprised of a plurality of independent elastomeric members, wherein each said working member is secured to a different elastomeric member than at least one other of said working members.

29. A lock pin in accordance with claim 26 which further includes an outwardly projecting arm adapted for receipt in an open space defined in the tooth to stabilize the tooth against unwanted turning and prevent erroneous insertion of the pin in the tooth.

30. A lock pin in accordance with claim 26 in which said casing further includes a partition extending transversely in said pocket.

31. A lock pin in accordance with claim 30 in which said one protrusion includes a flexible working member having a front portion overlying said elastomeric material for engaging the face of the adapter and a rear portion in engagement with said partition.

32. A lock pin for coupling a point to an adapter to form an excavating tooth, said lock pin comprising an elongate rigid casing having a unitary construction and at least two independently depressible protrusions, each of said protrusions including a working member and an elastomeric member, said elastomeric members of said two protrusions being independent and discrete with respect to one another, said casing defining a plurality of pockets for receiving and mounting said elastomeric members therein, one of said protrusions extending through a first gap in a front portion of said casing to engage a face of an adapter in order to tighten the connection of a point on an adapter, the other of said protrusions extending through a second gap in said casing to engage a recess to lock said lock pin to a point, said casing substantially encapsulating said elastomeric member of said other protrusion to shield it from external forces applied to the point during use.

33. A lock pin in accordance with claim 32 wherein said second gap is defined in a rear portion of said casing, and wherein said other protrusion extends therethrough in a direction opposite to said extension of said one protrusion.

34. A lock pin in accordance with claim 32 wherein each said working member is a rigid member attached to an outer portion of the respective elastomeric member.

35. A lock pin in accordance with claim 32 which further includes a plurality of said other protrusions, each of which extends through a gap defined in said casing to engage a recess in the point to thereby securely lock said lock pin in the point.

36. A lock pin in accordance with claim 35 in which at least one of said other protrusions is located at each end of said one protrusion.

37. A lock pin in accordance with claim 32 wherein said casing includes a front wall and said working member of said one protrusion is movable between a point of maximum expansion and a point of maximum compression of the elastomeric member to which it is attached, and wherein said front wall is located between said points of maximum expansion and maximum compression in order to protect said elastomeric member of said one protrusion from overloading.

38. A lock pin in accordance with claim 32 which further includes an outwardly projecting arm adapted for receipt in a gap defined in the tooth to stabilize the tooth against unwanted turning and prevent erroneous insertion of the pin in the tooth.

39. A lock pin for coupling a point to an adapter to form an excavating tooth, said lock pin comprising an elongate rigid casing having a unitary construction which rigidly resists external forces applied during use and a plurality of independently depressible protrusions, each said protrusion including a working member attached to elastomeric material, said casing including at least one recess for receiving and mounting said elastomeric material therein, said casing including a partition extending transversely in said recess, said casing having a first gap therein through which one of said protrusions extends to engage a face of an adapter in order to tighten the connection of a point on an adapter, and said casing having a second gap therein through which another of said protrusions extends to engage an opening in the point to lock said lock pin to the point.

40. A lock pin in accordance with claim 39 in which said one protrusion includes a flexible working member having a front portion overlying said elastomeric material for engaging the face of the adapter and a rear portion in engagement with said partition.

* * * * *